US006171748B1

(12) United States Patent
Tanaka et al.

(10) Patent No.: US 6,171,748 B1
(45) Date of Patent: Jan. 9, 2001

(54) PLATE FOR DIRECT THERMAL LITHOGRAPHY AND PROCESS FOR PRODUCING THE SAME

(75) Inventors: Migaku Tanaka; Kei Tomeba, both of Fuji (JP)

(73) Assignee: Asahi Kasei Kogyo Kabushiki Kaisha (JP)

( * ) Notice: Under 35 U.S.C. 154(b), the term of this patent shall be extended for 0 days.

(21) Appl. No.: 09/331,942

(22) PCT Filed: Dec. 18, 1997

(86) PCT No.: PCT/JP97/04686

§ 371 Date: Jun. 25, 1999

§ 102(e) Date: Jun. 25, 1999

(87) PCT Pub. No.: WO98/29258

PCT Pub. Date: Sep. 7, 1998

(30) Foreign Application Priority Data

Dec. 26, 1996 (JP) ..... 8-347984

(51) Int. Cl.[7] ..... G03C 1/72

(52) U.S. Cl. ..... 430/138; 430/270.1; 430/273.1; 430/302; 101/457; 101/467

(58) Field of Search ..... 430/138, 270.1, 430/273.1, 302; 101/453, 457, 467

(56) References Cited

U.S. PATENT DOCUMENTS

| | | | | |
|---|---|---|---|---|
| 3,274,929 | | 9/1966 | Newman et al. | 101/149.2 |
| 4,034,183 | | 7/1977 | Uhlig | 219/122 |
| 4,063,949 | | 12/1977 | Uhlig et al. | 96/27 |
| 4,755,445 | * | 7/1988 | Hasegawa | 430/138 |
| 4,755,466 | * | 7/1988 | Keys et al. | 430/138 |
| 5,368,973 | * | 11/1994 | Hasegawa | 430/138 |
| 5,569,573 | | 10/1996 | Takahashi et al. | 430/138 |
| 5,795,698 | * | 8/1998 | Fitzgerald | 430/281.2 |

FOREIGN PATENT DOCUMENTS

| | | |
|---|---|---|
| 62-1587 | 1/1987 | (JP) . |
| 62-164049 | 7/1987 | (JP) . |
| 62-164596 | 7/1987 | (JP) . |
| 63-64747 | 3/1988 | (JP) . |
| 1-113290 | 5/1989 | (JP) . |
| 3-108588 | 5/1991 | (JP) . |
| 5-8575 | 1/1993 | (JP) . |
| 7-1849 | 1/1995 | (JP) . |
| 7-1850 | 1/1995 | (JP) . |

* cited by examiner

*Primary Examiner*—Janet Baxter
*Assistant Examiner*—Barbara Gilmore
(74) *Attorney, Agent, or Firm*—Pennie & Edmonds LLP

(57) ABSTRACT

A lithoprinting plate comprising a support and a recording layer which comprises a polyvalent metal ion and a hydrophilic binder polymer having a Lewis base portion containing nitrogen, oxygen or sulfur and which has an oleophilic image area and a hydrophilic non-image area which are printed in a thermal mode, wherein the hydrophilic binder polymer in the hydrophilic non-image area is three-dimensionally cross-linked by the interaction between the polyvalent metal ion and the Lewis base portion.

25 Claims, No Drawings

PLATE FOR DIRECT THERMAL LITHOGRAPHY AND PROCESS FOR PRODUCING THE SAME

TECHNICAL FIELD

The present invention relates to a direct, heat-sensitive, lithoprinting, original plate for offset printing, a lithoprinting plate, a process for producing the same and a heat-sensitive, lithoprinting material.

BACKGROUND ART

Along with the popularization of computers, various processes for producing lithographic plates have been proposed together with plate material construction. From the aspect of practical use, a process has been generally carried out which comprises preparing a positive or negative film from a block copy and printing out the film on a lithoprinting, original plate. However, a so-called computer-to-plate (CTP) type lithographic material has been developed in which plate-making can be effected by printing the image information edited and prepared directly on a plate material by means of a laser or thermal head. The printed image information is edited and prepared by an electrophotographic plate or silver salt photographic plate for direct plate-making from a block copy without going through a positive or negative film, or by means of electronic composing or DTP (desktop publishment) without converting the information to a visual image. In particular, the CTP type lithographic material makes it possible to rationalize and shorten the plate-making process and to save material costs, so that it is greatly expected that it will find use in the fields of newspaper production in which CTS has been accomplished, commercial printing in which the prepress step has been digitized, and the like.

CTP type lithographic materials have been known which are of the photosensitive type, heat-sensitive type and the type where plate-making is achieved using electrical energy.

When using plate materials of a photosensitive type or a type in which plate-making is effected with electric energy, the plate price becomes high compared to the conventional PS plates, and the production apparatus therefor becomes oversize and expensive, so that these plate materials and the plate-making process using the same have not been put in practical use. Moreover, there is the problem of disposing of developers as wastes.

Some heat-sensitive type plate materials have been developed for light printing uses including in-house printing. JP-A-63-64,747, JP-A-1-113,290 and the like disclose plate materials in which a heat-meltable resin and a thermoplastic resin dispersed in a heat-sensitive layer provided on a support is melted by thermal printing to change the heated portion from hydrophilic to oleophilic. U.S. Pat. No. 4,034,183 and U.S. Pat. No. 4,063,949 disclose plate materials in which a hydrophilic polymer provided on a support is irradiated with a laser to remove the hydrophilic group, thereby converting it to oleophilic polymer. However, these plate materials have problems in that the heat-meltable material present on the support accepts an ink so as to contaminate the non-image area, the plate wear is insufficient, and the freedom of plate material design is restricted.

JP-A-3-108,588 and JP-A-5-8,575 disclose a plate material wherein a heat-sensitive recording layer consisting of a microencapsulated heat-meltable material and a bonding resin is provided on a support and the heated portion is converted to oleophilic. However, these plate materials are not satisfactory in plate wear because the image formed from the microencapsulated heat-meltable material is fragile. On the other than, JP-A-62-164,596 and JP-A-62-164,049 disclose a lithoprinting, original plate in which a recording layer consisting of an active hydrogen-containing binder polymer and a blocked isocyanate is provided on a support having a hydrophilic surface and a process for producing the same. However, this plate material requires a developing step for removing the non-printing portion after printing.

Moreover, one of the direct type lithoprinting materials is a direct drawing type lithoprinting material on which an image area is formed on the surface of a hydrophilic layer by an external means such as ink jet, a toner transcription or the like. JP-A-62-1,587 discloses a plate material for forming a toner-accepting layer by thermal printing which material is coated with a microencapsulated, non-reactive, heat-meltable material. However, this plate material can be used as a printing plate only after an oleophilic toner or the like is fixed on the toner-accepting layer formed, and not such that an image area is formed after the printing.

As mentioned above, a conventional, heat-sensitive, lithoprinting material is poor in plate wear or oleophilicity, so that the use thereof is limited to light printing and the like. Furthermore, some plate materials require a developing step in the plate-making process.

Therefore, JP-A-07-01,849 and JP-A-07-01,850 describe plate materials in the form of reactive microcapsules, which are converted to an image by heat, and which are dispersed in a three-dimensionally cross-linked hydrophilic binder. These plate materials have advantages in that since they are direct plate materials of thermal mode and near infrared laser is used as a source for energy to be applied, they can be handled in an ordinary room and the plate-making process can be greatly simplified because development is unnecessary. However, these plate materials have drawbacks in that (1) particularly when scores of thousands of copies are printed, the plate wear of image area and non-image area are low and (2) since curing by double bond is utilized as a means for strengthening the hydrophilic layer, the amount of double bond-containing groups which are oleophilic must be increased in the hydrophilic layer for strengthening and it is difficult to maintain an adequate balance between the strengthening of the hydrophilic layer and the development of non-imaging property.

As mentioned above, the prior art has a problem in respect of practice on a commercial level with regard to plate performance, plate-making apparatus, plate-making workability or the cost of plate material, plate-making or apparatus. In addition, it has a problem in that the direct lithographic plate which does not require development and which utilizes reactive microcapsules and a hydrophilic binder polymer is also low in plate wear in the image areas and the non-image areas in the case of printing large numbers of copies and it is difficult to maintain an adequate balance in designing the plate construction.

This invention aims at solving the above-mentioned problems of the prior direct type offset plate materials. That is to say, an object of this invention is to provide a lithoprinting, original plate at a low price from which a lithoprinting plate having a high plate wear and a high dimension accuracy is obtained and a contaminant-free printed matter having a clear image is obtained. Furthermore, it is another object of this invention to provide a lithoprinting, original plate which does not require a developing step which in turn requires disposal of developer wastes or the like and can be subjected to plate-making without using special-purpose, large-scale and expensive plate-making apparatus and to provide a plate-making process.

DISCLOSURE OF INVENTION

The present inventors have diligently made research for obtaining a lithoprinting, original plate from which a lithoprinting plate having a high plate wear and a high dimensional accuracy is obtained and a contaminant-free printed matter having a clear image is obtained. As a result they have found that a lithoprinting, original plate extremely excellent in the above-mentioned performance can be obtained by three-dimensionally cross-linking a hydrophilic binder polymer utilizing the interaction between a polyvalent metal ion and the Lewis base portion containing nitrogen, oxygen or sulfur present in the hydrophilic binder polymer, whereby this invention has been accomplished.

The present invention is described as follows:

(1) A lithoprinting plate comprising a support and a recording layer which comprises a polyvalent metal ion and a hydrophilic binder polymer having a Lewis base portion containing nitrogen, oxygen or sulfur and which has an oleophilic image area and a hydrophilic non-image area which are printed in thermal mode, wherein the hydrophilic binder polymer in the hydrophilic non-image area is three-dimensionally cross-linked by the interaction between the polyvalent metal ion and the Lewis base portion.

(2) A process for producing the lithoprinting plate according to (1) above, which comprises subjecting to printing in thermal mode a heat-sensitive, lithoprinting, original plate which comprises a support and a hydrophilic layer comprising fine particles which are converted to image area by heat and a hydrophilic binder polymer containing a polyvalent metal ion and having a Lewis base portion containing nitrogen, oxygen or sulfur, wherein the above hydrophilic binder polymer is three-dimensionally cross-linked by the interaction between the polyvalent ion and the Lewis base portion, to form an oleophilic image area in the hydrophilic layer.

(3) A heat-sensitive, lithoprinting, original plate which comprises a support and a hydrophilic layer comprising fine particles which are converted to an image area by heat and a hydrophilic binder polymer containing a polyvalent metal ion and having a Lewis base portion containing nitrogen, oxygen or sulfur, wherein the above hydrophilic binder polymer is three-dimensionally cross-linked by the interaction between the above polyvalent metal ion and the above Lewis base portion. The above heat-sensitive, lithoprinting, original plate can be used in the production of the lithoprinting plate according to (2) above.

(4) The heat-sensitive, lithoprinting, original plate according to (3) above, wherein the hydrophilic binder polymer has a functional group which chemically bonds with the fine particle component and the fine particle component has a functional group which chemically bonds with the above hydrophilic binder polymer.

(5) The heat-sensitive, lithoprinting, original plate according to (3) or (4) above, wherein the fine particles are of a microencapsulated oleophilic material.

(6) The heat-sensitive, lithoprinting, original plate according to (3), (4) or (5) above, which has a hydrophilic polymer thin film layer on the surface of the hydrophilic layer.

(7) The heat-sensitive, lithoprinting, original plate according to (3), (4), (5) or (6) above, wherein the polyvalent metal ion is at least one member selected from the group consisting of magnesium ion, aluminum ion, calcium ion, titanium ion, ferrous ion, cobalt ion, copper ion, strontium ion, zirconium ion, stannous ion, stannic ion and lead ion.

(8) The heat-sensitive, lithoprinting original plate according to (3), (4), (5), (6) or (7) above, in which the Lewis base portion containing nitrogen, oxygen or sulfur is at least one member selected from the group consisting of amino group, monoalkylamino group, dialkylamino group, trialkylamino group, isoureido group, isothioureido group, imidazolyl group, imino group, ureido group, epiimino group, ureylene group, oxamoyl group, oxalo group, oxaloaceto group, carbazoyl group, carbazolyl group, carbamoyl group, carboxyl group, carboxylato group, carboimido group, carbonohydrazido group, quinolyl group, guanidino group, sulfamoyl group, sulfinamoyl group, sulfoamino group, semicarbazido group, semicarbazono group, thioureido group, thiocarbamoyl group, triazano group, triazeno group, hydrazino group, hydrazo group, hydrazono group, hydroxyamino group, hydroxyimino group, nitrogen-containing heterocyclic ring, formamido group, formimidoyl group, 3-morpholinyl group and morpholino group.

(9) The heat-sensitive, lithoprinting, original plate according to (3), (4), (5), (6), (7) or (8) above, wherein the hydrophilic binder polymer is at least one member selected from the group consisting of a polymer which is composed of carbon—carbon bonds or composed of carbon atoms or carbon—carbon bonds connected with at least one hetero atom selected from the group consisting of oxygen, nitrogen, sulfur and phosphorus and which has in its polymer structure a Lewis base portion containing nitrogen, oxygen or sulfur which can interact or has interacted with the polyvalent metal ion; and this Lewis base portion-containing polymer which further contains in its polymer structure at least one hydrophilic, functional group selected from the group consisting of phosphoric acid group, sulfonic acid group or their salts, hydroxyl group and polyoxyethylene group.

(10) The heat-sensitive, lithoprinting, original plate according to (6), (7), (8) or (9) above, wherein the polymer used in the hydrophilic polymer thin film layer is at least one member selected from the group consisting of a polymer which is composed of carbon atoms or carbon—carbon bonds connected with at least one hetero atom selected from the group consisting of oxygen, nitrogen, sulfur and phosphor; a polymer which is composed of carbon—carbon bonds or composed of carbon atoms or carbon—carbon bonds connected with at least one hetero atom selected from the group consisting of oxygen, nitrogen, sulfur and phosphor and which contains in its structure at least one hydrophilic, functional group selected from the group consisting of phosphoric acid group, sulfonic acid group or their salts, hydroxyl group and polyoxyethylene group; a polymer which is composed of carbon—carbon bonds or composed of carbon atoms or carbon—carbon bonds connected with at least one hetero atom selected from the group consisting of oxygen, nitrogen, sulfur and phosphor and which has in its structure a Lewis base portion containing nitrogen, oxygen or sulfur; and this Lewis base portion-containing polymer which further contains in its structure at least one hydrophilic, functional group selected from the group consisting of phosphoric acid group, sulfonic acid group or their salts, hydroxyl group and polyoxyethylene group.

(11) The heat-sensitive, lithoprinting, original plate according to (3), (4), (5), (6), (7), (8), (9) or (10) above, wherein the hydrophilic binder polymer is a polymer synthesized using monomers comprising at least one member selected from the group consisting of (meth)acrylic acid, itaconic acid and their alkali metal or amine salts, (meth)acrylamide, N-monomethylol(meth)acrylamide, N-dimethylol(meth) acrylamide, allylamine and their mineral acid salts, and the polyvalent metal ion is at least one member selected from the group consisting of ferrous ion, zirconium ion and stannic ion.

(11-1) The heat-sensitive, lithoprinting, original plate according to (11) above, wherein the hydrophilic binder polymer is a polymer synthesized using further at least one member selected from the group consisting of vinylsulfonic acid, 2-acrylamido-2-methylpropanesulfonic acid, their alkali metal or amine salts, 2-sulfoethyl methacrylate, polyoxyethylene glycol mono(meth)acrylate and acid phosphoxypolyoxyethylene glycol mono(meth)acrylate.

(12) The heat-sensitive, lithoprinting, original plate according to (6), (7), (8), (9), (10) or (11) above, wherein the polymer used in the hydrophilic polymer thin film layer is a polymer synthesized using at least one member selected from the group consisting of (meth)acrylic acid, itaconic acid and their alkali metal or amine salts, (meth)acrylamide, N-monomethylol(meth)acrylamide, N-dimethylol(meth) acrylamide, allylamine and their mineral acid salts, vinylsulfonic acid, 2-acrylamido-2-methylpropanesulfonic acid and their alkali metal or amine salts, 2-sulfoethyl methacrylate, polyoxyethylene glycol mono(meth)acrylate and acid phosphoxypolyoxyethylene glycol mono(meth) acrylate.

(13) A process for producing the lithoprinting plate according to (1) above which comprises subjecting to printing in thermal mode, a heat-sensitive, lithoprinting material comprising a support and a hydrophilic layer containing fine particles which are converted to an image area by heat and an uncross-linked binder polymer having a Lewis base portion containing nitrogen, oxygen or sulfur to form an oleophilic image area; thereafter three-dimensionally cross-linking the hydrophilic binder polymer in the non-image area by the interaction between the multivalent metal ion fed from the exterior and the Lewis base portion.

(14) A heat-sensitive, lithoprinting material which comprises a support and a hydrophilic layer containing a hydrophilic binder polymer and fine particles which are converted to an image area by heat, wherein the hydrophilic binder polymer is an uncross-linked, hydrophilic binder polymer having a Lewis base portion containing nitrogen, oxygen or sulfur. The above heat-sensitive, lithoprinting material can be used in the production of a lithoprinting plate according to (13) above.

(15) The heat-sensitive, lithoprinting material according to (14) above, wherein the hydrophilic binder polymer has a functional group which chemically bonds with the fine particle component and the fine particle component has a functional group which chemically bonds with the above hydrophilic binder polymer.

(16) The heat-sensitive lithoprinting material according to (14) or (15) above, wherein the fine particles are of microencapsulated oleophilic materials.

(16-1) The heat-sensitive, lithoprinting material according to (14), (15) or (16) above, wherein the hydrophilic layer has a hydrophilic polymer thin film layer on its surface.

(17) The heat-sensitive, lithoprinting material according to (14), (15) or (16) above, wherein the Lewis base portion containing nitrogen, oxygen or sulfur is at least one member selected from the group consisting of amino group, monoalkylamino group, dialkylamino group, trialkylamino group, isoureido group, isothioureido group, imidazolyl group, imino group, ureido group, epiimino group, ureylene group, oxamoyl group, oxalo group, oxaloaceto group, carbazoyl group, carbazolyl group, carbamoyl group, carboxyl group, carboxylato group, carboimidoyl group, carbonohydrazido group, quinolyl group, guanidino group, sulfamoyl group, sulfinamoyl group, sulfoamino group, semicarbazido group, semicarbazono group, thioureido group, thiocarbamoyl group, triazano group, triazeno group, hydrazino group, hydrazono group, hydroxyamino group, hydroxyimino group, nitrogen-containing, heterocyclic ring, formamido group, formimidoyl group, 3-morpholinyl group and morpholino group.

(18) The heat-sensitive, lithoprinting material according to (14), (15), (16) or (17) above, wherein the hydrophilic binder polymer is at least one member selected from the group consisting of a polymer which is composed of carbon—carbon bonds or composed of carbon atoms or carbon—carbon bonds connected with at least one hetero atom selected from the group consisting of oxygen, nitrogen, sulfur and phosphor and which has, in its polymer structure, a Lewis base portion containing nitrogen, oxygen or sulfur which portion can interact or has interacted with the polyvalent metal ion; and this Lewis base portion-containing polymer which further contains in its polymer structure at least one hydrophilic functional group selected from the group consisting of phosphoric acid group, sulfonic acid group or their salts, hydroxyl group and polyoxyethylene.

(19) The heat-sensitive, lithoprinting material according to (14), (15), (16), (17) or (18) above, wherein the polymer used in the hydrophilic polymer thin film layer is at least one member selected from the group consisting of a polymer which is composed of carbon atoms or carbon—carbon bonds connected with at least one hetero atom selected from the group consisting of oxygen, nitrogen, sulfur and phosphor; a polymer which is composed of carbon—carbon bonds or composed of carbon atoms or carbon—carbon bonds connected with at least one hetero atom selected from the group consisting oxygen, nitrogen, sulfur and phosphor and which has, in its structure, at least one hydrophilic, functional group selected from the group consisting of phosphoric acid group, sulfonic acid group or their salts, hydroxyl group and polyoxyethylene group; a polymer which is composed of carbon—carbon bonds or composed of carbon atoms or carbon—carbon bonds connected with at least one hetero atom selected from the group consisting of oxygen, nitrogen, sulfur and phosphor and which has, in its structure, a Lewis base portion containing nitrogen, oxygen or sulfur; and this Lewis base portion-containing polymer which has, in its structure, at least one hydrophilic, functional group selected from the group consisting of phosphoric acid group, sulfonic acid group or their salts, hydroxyl group and polyoxyethylene group.

(20) The heat-sensitive, lithoprinting material according to (14), (15), (16), (17), (18) or (19) above, wherein the hydrophilic binder polymer is a polymer synthesized using monomers comprising at least one member selected from the group consisting of (meth)acrylic acid, itacohic acid and their alkali metal or amine salts, (meth)acrylamide, N-monomethylol(meth)acrylamide, N-dimethylol(meth) acrylamide and allylamine and its mineral acid salts.

(20-1) The heat-sensitive, lithoprinting material according to (20) above, wherein the hydrophilic binder polymer is a polymer synthesized by further using at least one member selected from the group consisting of vinylsulfonic acid, 2-acrylamido-2-methylpropanesulfonic acid, their alkali metal or amine salts, 2-sulfoethyl methacrylate, polyoxyethylene glycol mono(meth)acrylate and acid phosphoxypolyoxyethylene glycol mono(meth)acrylate.

(21) The heat-sensitive, lithoprinting material according to (17), (18), (19) or (20) above, wherein the polymer used in the hydrophilic polymer thin film layer is a polymer synthesized using at least one member selected from the group consisting of (meth)acrylic acid, itaconic acid and their alkali metal or amine salts, (meth)acrylamide, N-monomethylol(meth)acrylamide, N-dimethylol(meth)

acrylamide, allylamine and its mineral acid salts, vinylsulfonic acid, 2-acrylamido-2-methylpropanesulfonic acid and their alkali metal or amine salts, 2-sulfoethyl methacrylate, polyoxyethylene glycol mono(meth)acrylate and acid phosphoxypolyoxyethylene glycol mono(meth)acrylate.

MODE FOR CARRYING OUT THE INVENTION

In the lithoprinting plate produced from the heat-sensitive, original, lithoprinting plate of this invention, the hydrophilic layer comprising a hydrophilic binder polymer three-dimensionally cross-linked by the interaction between the polyvalent metal ion and the Lewis base portion is ink-repellent and constitutes the main component of the non-image area. Moreover, when a thin film layer composed of a hydrophilic polymer is provided on the surface of the hydrophilic layer, the layer inhibits the surface from accepting tinting-causing materials coming flying from the exterior and chemically traps the residual polyvalent metal ion-generating chemicals, whereby the tinting at the beginning of printing can be greatly diminished. In particular, when it is allowed to stand for a long period of time after the interaction between the polyvalent metal ion and the Lewis base in the hydrophilic binder polymer has been caused, it is preferable to provide the thin film layer. Practically, taking into consideration the fact that in a large number of cases, the plate which has been allowed to stand for a certain time after drying is provided, it is highly advantageous to provide the thin film layer.

As the hydrophilic binder polymer having a three-dimensional, cross-linked structure, there are mentioned a polymer which is composed of carbon—carbon bonds or composed of carbon atoms or carbon—carbon bonds connected with at least one hetero atom selected from the group consisting of oxygen, nitrogen, sulfur and phosphor, for example, a polymer of poly(meth)acrylate type, polyoxyalkylene type, polyurethane type, epoxy ring-opening addition polymerization type, poly(meth)acrylic acid type, poly(meth)acrylamide type, polyester type, polyamide type, polyamine type, polyvinyl type, polysaccharide type or the like or their composite type, and which has in its structure a Lewis base portion containing nitrogen, oxygen or sulfur and has been three-dimensionally cross-linked by the interaction between the Lewis base portion and the polyvalent metal ion; and a polymer which is composed of carbon atoms or carbon—carbon bonds connected with at least one hetero atom selected from the group consisting of oxygen, nitrogen, sulfur and phosphor, for example, a polymer of poly(meth)acrylate type, polyoxyalkylene type, polyurethane type, epoxy ring-opening addition polymerization type, poly(meth)acrylic acid type, poly(meth)acrylamide type, polyester type, polyamide type, polyamine type, polyvinyl type, polysaccharide type or the like or their composite type, and which contains in its structure hydrophilic, functional groups, preferably at least one member selected from phosphoric acid group, sulfonic acid group or their salts, hydroxyl group and polyoxyethylene group, and has been reticulated by the interaction between the Lewis base portion and the polyvalent metal ion.

In this invention, the hydrophilic binder polymer is preferably a hydrophilic binder polymer which has, in addition to the Lewis base portion which has interacted with the polyvalent metal ion, a Lewis base portion which has not participated in the interaction and has repeatedly a segment having any one of hydroxyl group, sulfonic acid group and its alkali metal, alkaline earth metal or amine salt or having them in combination, and more preferably a hydrophilic binder polymer having further these hydrophilic, functional groups and a polyoxyethylene group in a part of the main chain segment because its hydrophilicity is high. Those having, in addition thereto, a urethane or urea bond in the main chain or side chain of the hydrophilic binder polymer are particularly preferable because not only the hydrophilicity but also the plate wear of the non-image area is enhanced.

The three-dimensional, cross-linked structure due to the polyvalent metal ion of the hydrophilic binder polymer may be formed either before or after the printing and there can be used those in which the hydrophilic binder polymer has no three-dimensional, cross-linked structure due to the polyvalent metal ion. However, from the view-point of preventing from scratching during handling, from the viewpoint that when printing is effected by a thermal head, the heat-melted, hydrophilic layer components are prevented from adhering to the thermal head, and from the viewpoint of simplification of the steps after the printing, it is preferable that the formation of the three-dimensional, cross-linked structure has been completed.

In this invention, the noncross-linked, hydrophilic binder polymer means a polymer which has no three-dimensional, cross-linked structure formed by the interaction between the polyvalent metal ion and the Lewis base portion and which is in the stage before the hydrophilic binder polymer is prepared. The above noncross-linked, hydrophilic binder polymer may have three-dimensional, cross-linked structures formed by various three-dimensional cross-linking methods as described hereinafter. In this invention, the term "heat-sensitive, lithoprinting material" means a plate which is in the stage before the heat-sensitive, lithoprinting, original plate is prepared and which does not have the three-dimensional, cross-linked structure formed by the interaction between the polyvalent metal ion and the Lewis base portion.

The proportion of the above-mentioned hydrophilic, functional group in the hydrophilic binder polymer may be adequately determined empirically by the method described below for each sample depending upon the kind of the above-mentioned main chain segment and the kind of the hydrophilic, functional group used. The hydrophilicity of the hydrophilic binder polymer of this invention is evaluated by forming on a support a heat-sensitive, lithoprinting, original plate, i.e., heat-sensitive, lithoprinting material comprising a hydrophilic binder polymer or noncross-linked, hydrophilic binder polymer, subjecting the same to the preparation of a printing plate and print test according to the method described in the Examples, and judging whether or not an ink has attached to a printing paper or determining the reflection density difference of the paper in the non-image area before and after the printing (for example, measuring by Reflection Densitometer DM400, manufactured by DAINIPPON SCREEN MFG. CO., LTD.) or alternatively by judging whether or not kerosene has attached to the sample by a method of measuring contact angle according to an oil-in-water method using water-kerosene (for example, measuring by Contact Angle Meter, Model CA-A, manufactured by Kyowa Surface Science).

When the hydrophilicity is evaluated by the former method, the case where no ink contamination is recognized by visual observation is deemed to be good and the case where ink contamination is recognized is deemed to be bad or the case where the reflection density difference in the non-image area before and after the printing is less than 0.01 is deemed to be good and the case where it is at least 0.01 is deemed to be bad. When the hydrophilicity is evaluated by the latter method, it is necessary that the above contact angle be larger than about 150 degrees, preferably not smaller than 160 degrees, for a printing plate for which a low density ink is used as in the newspaper printing. For a printing plate for which a high viscosity ink which is kneaded before use in printing, is used, it is necessary that the above contact angle be larger than about 135 degrees.

As the polymer to be used in the hydrophilic polymer thin film layer provided on the surface of the hydrophilic layer of this invention, the same kind of polymer as in the hydrophilic binder polymer can be used; however, no dimensional cross-linking with the polyvalent metal ion is necessary, so that the Lewis base portion containing nitrogen, oxygen or sulfur which is essential for the hydrophilic binder polymer is not essential. As the polymer to be used in the hydrophilic polymer thin film layer, there are mentioned a polymer composed of carbon atoms or carbon—carbon bonds connected with at least one hetero atom selected from the group consisting of oxygen, nitrogen, sulfur and phosphor, for example, a polymer of poly(meth)acrylate type, polyoxyalkylene type, polyurethane type, epoxy ring-opening addition polymerization type, poly(meth)acrylic acid type, poly (meth)acrylamide type, polyester type, polyamide type, polyamine type, polyvinyl type, polysaccharide type or the like or their composite type; a polymer which is composed of carbon—carbon bonds or composed of carbon atoms or carbon—carbon bonds connected with at least one hetero atom selected from the group consisting of oxygen, nitrogen, sulfur and phosphor, for example, a polymer of poly(meth) acrylate type, polyoxyalkylene type, polyurethane type, epoxy ring-opening addition polymerization type, poly (meth)acrylic acid type, poly(meth)acrylamide type, polyester type, polyamide type, polyamine type, polyvinyl type, polysaccharide type, or the like or their composite type and which contains, in its structure, at least one hydrophilic, functional group such as hydroxyl group, phosphoric acid group, sulfonic acid group, polyoxyethylene group and the like; a polymer which is composed of carbon—carbon bonds or composed of carbon atoms or carbon—carbon bonds connected with at least one hetero atom selected from the group consisting of oxygen, nitrogen, sulfur and phosphor, for example, a polymer of poly(meth)acrylate type, polyoxyalkylene type, polyurethane type, epoxy ring-opening addition polymerization type, poly(meth)acrylic acid type, poly(meth)acrylamide type, polyester type, polyamide type, polyamine type, polyvinyl type, polysaccharide type or the like or their composite type and which contains, in its structure, a Lewis base portion containing nitrogen, oxygen or sulfur; and a polymer which is composed of carbon—carbon bonds or composed of carbon atoms or carbon—carbon bonds connected with at least one of the hetero atom consisting of oxygen, nitrogen, sulfur and phosphor, for example, a polymer of poly(meth)acrylate type, polyoxyalkylene type, polyurethane type, epoxy ring-opening addition polymerization type, poly(meth)acrylic acid type poly (meth)acrylamide type, polyester type, polyamide type, polyamine type, polyvinyl type, polysaccharide type or the like or their composite type and which contains in its structure at least one hydrophilic functional group such as hydroxyl group, phosphoric acid group, sulfonic acid group, polyoxyethylene group and the like and further contains in its structure a Lewis base portion. However, desirably, when the affinity and adherability to the hydrophilic layer and the residual polyvalent metal ion-generating chemicals are taken into consideration, it is preferable that the polymer has the same kind of Lewis base portion and the same hydrophilic, functional group such as phosphoric acid group, sulfonic acid group, polyoxyethylene group or the like as the above hydrophilic binder polymer has.

The molecular weight of the polymer used in the hydrophilic polymer thin film layer is about 1,000 to 1,000,000, preferably about 3,000 to 100,000. When the molecular weight is lower than this range, the hydrophilic layer per se is made fragile and when the molecular weight is higher than this range, the image formation is disturbed and the desired effect does not appear in some cases.

The specific modes in which the interaction between the Lewis base portion and the polyvalent metal ion referred to in this invention is developed are as follows:

The heat-sensitive, lithoprinting material referred to in this invention can be obtained by mixing the noncross-linked, hydrophilic binder polymer containing the Lewis base portion in the structure with another component necessary to the lithoprinting plate as stated hereinafter to prepare a dope, coating this on a support and drying the same. Thereafter, when a polyvalent metal ion is fed from the exterior by the immersion of a heat-sensitive, lithoprinting material in such an aqueous or organic solvent solution as to generate the polyvalent metal ion or by the coating or spraying a heat-sensitive, lithoprinting material with the said solution, the interaction of the polyvalent metal ion with the Lewis base portion is developed to form a three-dimensional cross-linkage, whereby the heat-sensitive, lithoprinting, original plate can be obtained.

Moreover, the specific mode of providing the hydrophilic polymer thin film layer on the heat-sensitive, lithoprinting, original plate is as follows. That is, as a method of providing the hydrophilic polymer thin film layer on the hydrophilic layer surface, it comprises coating the hydrophilic layer surface with an aqueous or organic solution of the hydrophilic polymer on the hydrophilic layer surface by a bar coater, a blade coater or the like or spraying by a spray, or immersing the plate in the hydrophilic polymer solution. Since, in some cases, the hydrophilic layer of the plate just after the polyvalent metal ion has been fed from the aqueous or organic solution has become fragile to a sharp force, it is preferable to feed, not in contact, the solution of a polymer for the hydrophilic polymer thin film layer, and in this respect, the use of the spray system or immersion system is preferred. The concentration of the aqueous organic solution of the hydrophilic polymer used is preferably 0.01% by weight to 50% by weight, more preferably 0.1% by weight to 10% by weight. At a concentration lower than this range, the amount of the thin film material present on the hydrophilic layer surface is too small and the chemical trapping of the residual polyvalent metal ion-generating chemicals is not sufficiently effected in some cases. Furthermore, at a concentration higher than this range, the amount of the thin film material is too large and the image formation is prevented in some cases. In this invention, the thickness of the hydrophilic polymer thin film layer provided on the hydrophilic layer surface is 0.01 to 10 $\mu$m, preferably 0.1 to 1 $\mu$m.

Moreover, the lithoprinting plate referred to in this invention can be obtained by feeding the polyvalent metal ion from the exterior to the above heat-sensitive, lithoprinting material, after printing in a thermal mode, by the above mentioned method using such an aqueous or organic solution as to generate the polyvalent metal ion and thereafter providing the hydrophilic polymer thin film layer on the hydrophilic layer surface.

After the polyvalent metal ion has been fed, if removal of the excess chemicals present on the plate surface is necessary, washing with a suitable wash liquid may be effected. As the wash liquid, there can be used water and, in addition thereto, a dilute aqueous solution of a mineral acid such as hydrochloric acid, sulfuric acid, nitric acid or the like, a dilute solution of a surface active agent and also an organic solvent. The washing is preferably effected just after the feeding of the polyvalent metal ion. Furthermore, when the hydrophilic polymer thin film layer is provided, it is preferable to effect the same immediately after the feeding of the polyvalent metal ion or the washing. If the hydrophilic polymer thin film layer is dried before providing it on the hydrophilic layer surface, then the adhesion of oil components from the exterior, the denaturation of the residual chemicals, and the like result in tinting, whereby the effect of this invention is not sufficiently obtained in some cases.

In this invention, the method of three-dimensionally cross-linking by the above-mentioned interaction between the polyvalent metal ion and the Lewis base portion may be used together with at least one of the various three-dimensionally cross-linking methods mentioned hereinafter. Moreover, the hydrophilic binder polymer of this invention may, if necessary, contain various other components as mentioned hereinafter.

The polyvalent metal ion of this invention is fed from the exterior to the heat-sensitive, lithoprinting material or the heat-sensitive lithoprinting material printed in a thermal mode mainly through a solution such as an aqueous solution or the like.

The metal salts may be those which are dissolved in water or an aqueous solution of a mineral acid such as hydrochloric acid, sulfuric acid, nitric acid or the like or an aqueous solution of an alkali such as sodium hydroxide, potassium hydroxide, ammonia or the like to generate at least one member of metal ions or metal complex ions of magnesium ion, aluminum ion, calcium ion, titanium ion, ferrous ion, cobalt ion, copper ion, strontium ion, zirconium ion, stannous ion, stannic ion and lead ion, and, for example, as specific examples of the metal salts, there are used metal halides such as magnesium chloride, magnesium bromide, aluminum chloride, calcium chloride, ferrous chloride, ferrous bromide, cobalt chloride, cobalt bromide, cupric chloride, cupric bromide, strontium chloride, strontium bromide, stannous chloride, stannic chloride and the like; nitrates such as magnesium nitrate, aluminum nitrate, calcium nitrate, ferrous nitrate, cobalt nitrate, copper nitrate, strontium nitrate, lead nitrate and the like; sulfates such as magnesium sulfate, aluminum sulfate, ferrous sulfate, cobalt sulfate, titanium sulfate, copper sulfate and the like; acetates such as calcium acetate, zirconium acetate, copper acetate, lead acetate and the like; and, in addition thereto, there are also used ammonium zirconium carbonate; iron ferrocyanide; iron ferricyanide; and the like. Among them, zirconium acetate, stannous chloride and stannic chloride are particularly preferably used.

The concentration of the solution containing the polyvalent metal ion may be varied depending upon the kind of the metal and the kind of counter anion; however, the salt concentration is preferably 0.01 to 50% by weight, more preferably 0.2 to 20% by weight. The proportion in the hydrophilic binder polymer of the Lewis base portion which, when these polyvalent metal ions are fed, interacts with the polyvalent metal ion to form a three-dimensionally cross-linked structure is preferably 10 to 100 mole %, more preferably 60 to 100 mole %, based on the total number of the Lewis base portions present before the feeding of the ions.

Next, examples of the specific mode of the formation of the three-dimensional cross-linkage by the interaction between the polyvalent metal ion and the Lewis base portion in the hydrophilic binder polymer in this invention are described.

As the hydrophilic binder polymer, a hydrophilic homopolymer or copolymer having a Lewis base portion containing at least one member selected from nitrogen, oxygen and sulfur is synthesized using as the essential monomer a hydrophilic monomer having a Lewis base portion such as (meth)acrylic acid, its alkali metal or maine salt, itaconic acid, its alkali metal or amine salt, (meth) acrylamide, N-monomethylol(meth)acrylamide, N-dimethylol(meth)acrylamide or allylamine and further using, if necessary, at least one monomer selected from hydrophilic monomers having a hydrophilic group such as sulfonic acid group, phosphoric acid group, salt of amino group, hydroxyl group, ether group or the like such as 3-vinylpropionic acid, its alkali metal or maine salt, vinylsulfonic acid, its alkali metal or amine salt, 2-sulfoethyl (meth)acrylate, polyoxyethylene glycol mono(meth) acrylate, 2-acrylamido-2-methylpropanesulfonic acid, acid phosphoxypolyoxyethylene glycol mono(meth)acrylate, hydrohalogenic acid salt of allylamine or the like. The above homopolymer or copolymer is mixed with other components necessary to the lithoprinting plate as mentioned hereinafter and the mixture is dispersed and/or dissolved in a suitable solvent to prepare a dope. Moreover, for example, a natural high polymer containing a Lewis base portion such as carboxymethyl cellulose, gelatine, casein or alginic acid derivative may be mixed with other components necessary to the lithoprinting plate as mentioned hereinafter and then dispersed and/or dissolved in a suitable solvent to prepare a dope. By coating the dope on a support and drying the same, the heat-sensitive, lithoprinting material referred to in this invention can be obtained.

Thereafter, the polyvalent metal ion is fed from the exterior by immersing the heat-sensitive, lithoprinting material in such an aqueous or organic solution as to generate the polyvalent metal ion or spraying or coating the heat-sensitive, lithoprinting material with the solution, upon which the interaction between the polyvalent metal ion and the Lewis base portion is developed to form a three-dimensional cross-linkage, whereby the heat-sensitive, lithoprinting, original plate referred to in this invention can be obtained. Moreover, if necessary, to this hydrophilic layer surface can be applied a solution of a polymer for a hydrophilic polymer thin film layer by a method such as immersion, spraying or the like to provide a hydrophilic polymer thin film layer. In addition, after printing the heat-sensitive, lithoprinting material in a thermal mode, the polyvalent metal ion is fed from the exterior in the same manner as mentioned above using such an aqueous or organic solution as to generate the ion and thereafter a hydrophilic polymer thin film layer is provided on the hydrophilic layer surface, upon which the lithoprinting plate referred to in this invention can be obtained by the same mechanism as mentioned above.

For the hydrophilic binder polymer of this invention, there can be co-used at least one of the three-dimensionally cross-linking methods mentioned hereinafter in addition to the three-dimensionally cross-linking method based on the interaction between the polyvalent metal ion and the Lewis base which has been explained above, or at least one of the polymers three-dimensionally cross-linked by such a method as shown below may be co-used as the hydrophilic binder polymer.

From the hydrophilic binder polymer having a functional group such as carboxyl group, amino group or its salt, hydroxyl group, epoxy group or the like, there can be obtained an unsaturated group-containing polymer by introducing an ethylenic, addition-polymerizable unsaturated group such as vinyl group, allyl group, (meth)acryl group or the like or a ring-forming group such as cinnamoyl group, cinnamylidene group, cyanocinnamylidene group, p-phenylene diacrylate group or the like by utilizing the above functional groups. To the above unsaturated group-containing polymer are added, if necessary, a monofunctional or polyfunctional monomer copolymerizable with the above unsaturated group and a polymerization initiator and inorganic filler as mentioned below and if necessary, a lubricant as mentioned below, and they are dissolved in a suitable solvent to prepare a dope. The dope is coated on a support, and after drying or by repeating the drying, three-dimensional cross-linking is effected.

The hydrophilic binder polymer containing the active hydrogen of hydroxyl group, amino group, carboxyl group and the like is three-dimensionally cross-linked by adding the polymer together with an isocyanate compound or a block polyisocyanate compound and other components mentioned hereinafter to an active hydrogen-free solvent to prepare a dope, coating this dope on a support and reacting the same after or simultaneously with drying.

As the copolymeric component of the hydrophilic binder polymer, there can be used monomers having a glycidyl group such as glycidyl (meth)acrylate or the like; monomers having a carboxyl group such as (meth)acrylic acid or the like; or monomers having an amino group. The hydrophilic binder polymer having a glycidyl group can be three-dimensionally cross-linked using as a cross-linking agent an α,ω-alkane- or alkene-dicarboxylic acid such as 1,2-ethanedicarboxylic acid, adipic acid or the like; a polycarboxylic acid such as 1,2,3-propanetricarboxylic acid, trimellitic acid or the like; a polyamine compound such as 1,2-ethanediamine, diethylenediamine, diethylenetriamine, α,ω-bis(3-aminopropyl)polyethylene glycol ether or the like; an oligoalkylene or polyalkylene glycol such as ethylene glycol, propylene glycol, diethylene glycol, tetraethylene glycol or the like; a polyhydroxy compound such as trimethylolpropane, glycerol, pentaerythritol, sorbitol or the like and utilizing ring-opening reaction with them.

The hydrophilic binder polymer having a carboxyl group or an amino group can be three-dimensionally cross-linked utilizing an epoxy ring-opening reaction in which as a cross-linking agent is used a polyepoxy compound such as ethylene or propylene glycol diglycidyl ether, polyethylene or polypropylene glycol diglycidyl ether, neopentyl glycol diglycidyl ether, 1,6-hexanediol diglycidyl ether, trimethylolpropane triglycidyl ether or the like.

When the hydrophilic binder polymer is a polysaccharide such as cellulose derivative or the like; a polyvinyl alcohol or its partial saponification product; or a glycidol homo- or co-polymer, or comprises the same, it is possible to introduce a functional group capable of the above-mentioned cross-linking reaction by utilizing the hydroxyl groups contained in these compounds and three-dimensionally cross-link the hydrophilic binder polymer by the above-mentioned method.

An ethylene-addition-polymerizable unsaturated group or ring-forming group is introduced into a hydrophilic polyurethane precursor synthesized from a polyol having a hydroxyl groups at the polymer ends such as polyoxyethylene glycol or the like, a polyamine having amino groups at the polymer ends and a polyisocyanate such as 2,4-tolylene diisocyanate, 2,6-tolylene diisocyanate, 1,6-hexamethylene diisocyanate, isophorone diisocyanate or the like to form a hydrophilic binder polymer and this can be three-dimensionally cross-linked by the above-mentioned method.

When the above synthesized hydrophilic polyurethane precursor has terminal isocyanate groups, it is reacted with a compound having active hydrogen such as glycerol mono (meth)acrylate, 2-hydroxyethyl (meth)acrylate, 2-hydroxypropyl (meth)acrylate, N-monomethylol(meth) acrylamide, N-dimethylol(meth)acrylamide, (meth)acrylic acid, cinnamic acid, cinnamyl alcohol or the like to effect three-dimensional cross-linking. When the hydrophilic polyurethane precursor has terminal hydroxyl groups or terminal amino groups, the precursor is reacted with (meth)acrylic acid, glycidyl (meth)acrylate, 2-isocyanatoethyl (meth) acrylate or the like to effect three-dimensional cross-linking.

When the hydrophilic binder polymer is a polymer formed from a polybasic acid and a polyol or from a polybasic acid and a polyamine, these are coated on a support and then heated to effect three-dimensional cross-linking. When the hydrophilic binder polymer is casein, glue, gelatine or the like, a water-soluble colloid-forming compound thereof may be three-dimensionally cross-linked by heating to form a reticular structure.

Moreover, a three-dimensionally cross-linked hydrophilic binder polymer can be formed by reacting a hydrophilic polymer having hydroxyl groups or amino groups such as a homo- or copolymer synthesized from a hydroxyl group-containing monomer such as 2-hydroxyethyl (meth)acrylate, vinyl alcohol or the like, and allylamine; a partially saponified polyvinyl alcohol; a polysaccharide such as a cellulose derivative or the like; glycidol homo- or co-polymer; or the like, with a polybasic acid anhydride having at least two acid anhydride groups in one molecule. As the polybasic acid anhydride to be used in this reaction, there are mentioned ethylene glycol-bis(anhydrotrimellitate), glycerol-tris (anhydrotrimellitate), 1,3,3a,4,5,9b-hexahydro-5-(tetrahydro-2,5-dioxo-3-furanyl)naphtho[1,2-C]furan-1,3-dione, 3,3',4,4'-diphenylsulfonetetracarboxylic dianhydride, 1,2,3,4-butanetetracarboxylic dianhydride and the like.

When the hydrophilic binder polymer is formed from a polyurethane having terminal isocyanate groups and an active hydrogen-containing compound such as polyamine, polyol or the like, it is possible to dissolve or disperse these compounds and other components as mentioned hereinafter in a solvent, coat this liquid on a support, then remove the solvent, and thereafter, cure the coated support at such a temperature that the microcapsules are not broken to effect the three-dimensional cross-linking. In this case, the hydrophilicity may be imparted by introducing the segment of either or both of the polyurethane and the active hydrogen-containing compound or introducing a hydrophilic, functional group into the side chain. The hydrophilicity-developing segment and functional group may be adequately selected from those mentioned above.

As the polyisocyanate compound to be used in this invention, there are mentioned 2,4-tolylene diisocyanate, 2,6-tolylene diisocyanate, 4,4,-diphenylmethane diisocyanate, 1,5-naphthalene diisocyanate, tolidine diisocyanate, 1,6-hexamethylene diisocyanate, isophorone diisocyanate, xylylene diisocyanate, lysine diisocyanate, triphenylmethane triisocyanate, bicycloheptane triisocyanate and the like.

For the purpose of preventing the isocyanate group from being changed during handling before and after the coating step, it is preferable in some cases to block (mask) the isocyanate group beforehand by a known method. For example, according to the method stated in "Plastic Material Course (2), Polyurethane Resin" by keiji Iwata published by Nikkan Kogyo Shinbunsha (1974), pages 51–52, "Polyurethane Resin Handbook" by Yoshiharu Iwata published by Nikkan Kogyo Shinbunsha (1987), pages 98, 419, 423 and 499, the blocking can be effected with acid sodium sulfite, an aromatic secondary amine, a tertiary alcohol, an amide, phenol, a lactam, a heterocyclic compound, a ketoxime or the like. Among them, for example, diethyl malonate, ethyl acetoacetate and the like which have a low isocyanate-regenerating temperature are preferable.

An addition-polymerizable unsaturated group may be introduced into either the above-mentioned non-blocked polyisocyanate or blocked polyisocyanate and utilized in strengthening the cross-linkage and reaction with the oleophilic component.

In the above discussions, the hydrophilic binder polymer is preferably prepared by subjecting to three-dimensional cross-linking by the interaction between the polyvalent metal ion and the Lewis base portion and the other methods a hydrophilic homo- or copolymer which has a Lewis base portion containing at least one member selected from nitrogen, oxygen and sulfur and which has been synthesized using, as the essential monomer, a hydrophilic monomer having a Lewis base portion such as (meth)acrylic acid, its alkali metal or amine salt, itaconic acid, its alkali or amine salt, (meth)acrylamide, N-monomethylol(meth)acrylamide, N-dimethylol(meth)acrylamide or allylamine and further using, if necessary, at least one monomer selected from hydrophilic monomers having a hydrophilic group such as sulfonic acid group, phosphoric acid group, salt of amino group, hydroxyl group, ether group or the like, for example, 3-vinylpropionic acid, its alkali metal or amine salt, vinylsulfonic acid, its alkali metal or amine salt, 2-sulfoethyl (meth)acrylate, polyoxyethylene glycol mono(meth) acrylate, 2-acrylamido-2-methylpropanesulfonic acid, acid phosphoxypolyoxyethylene glycol mono(meth)acrylate, hydrohalogenic acid salt of allylamine or the like.

The hydrophilic binder polymer of this invention may be a polymer obtained by polymerizing the following monofunctional monomers or polyfunctional monomers in combination. The monofunctional monomers or polyfunctional monomers include specifically, for example, N,N'-methylenebisacrylamide, (meth)acryloylmorpholine, vinylpyridine, N-methyl(meth)acrylamide, N,N-dimethyl (meth)acrylamide, N,N-dimethylaminopropyl(meth) acrylamide, N,N-dimethylaminoethyl (meth)acrylate, N,N-diethylaminoethyl (meth)acrylate, N,N-dimethylaminoneopentyl (meth)acrylate, N-vinyl-2-pyrrolidone, diacetoneacrylamide, N-methylol(meth) acrylamide, parastyrenesulfonic acid or its salts, methoxytriethylene glycol (meth)acrylate, methoxytetraethylene glycol (meth)acrylate, methoxypolyethylene glycol (meth)acrylate (number average molecular weight of PEG: 400), methoxypolyethylene glycol (meth)acrylate (number average molecular weight of PEG: 1,000), butoxyethyl (meth)acrylate, phenoxyethyl (meth)acrylate, phenoxydiethylene glycol (meth)acrylate, phenoxypolyethylene glycol (meth)acrylate, nonylphenoxyethyl (meth)acrylate, dimethyloltricyclodecane di(meth)acrylate, polyethylene glycol di(meth)acrylate (number average molecular weight of PEG: 400), polyethylene glycol di(meth)acrylate (number average molecular weight of PEG: 600), polyethylene glycol di(meth)acrylate (number average molecular weight of PEG: 1,000), polypropylene glycol di(meth)acrylate (number average molecular weight of PPG: 400), 2,2-bis[4-(methacryloxyethoxy)phenyl]propane, 2,2-bis[4-(methacryloxy•diethoxy)phenyl]propane, 2,2-bis[4-(methacryloxy•polyethoxy)phenyl]propane or its acrylate, β-(meth)acryloyloxyethyl hydrogenphthalate, β-(meth) acryloyloxyethyl hydrogensuccinate, polyethylene or polypropylene glycol mono(meth)acrylate, 3-chloro-2-hydroxypropyl (meth)acrylate, 1,3-butylene glycol di(meth) acrylate, 1,6-hexanediol di(meth)acrylate, neopentyl glycol di(meth)acrylate, trimethylolpropane (meth)acrylate, tetramethylolmethane tri(meth)acrylate, tetramethylolmethane tetra(meth)acrylate, isobornyl (meth)acrylate, lauryl (meth) acrylate, tridecyl (meth)acrylate, stearyl (meth)acrylate, isodecyl (meth)acrylate, cyclohexyl (meth)acrylate, tetrafurfuryl (meth)acrylate, benzyl (meth)acrylate, mono(2-acryloyloxyethyl) acid phosphate or its methacrylate, glycerol mono- or di-(meth)acrylate, tris(2-acryloxyethyl) isocyanurate or its methacrylate, N-phenylmaleimide, N-(meth)acryloxysuccinimide, N-vinylcarbazole, divinylethyleneurea, divinylpropyleneurea and the like, which are mentioned in "Cross-Linking Agent Handbook" edited by Shinzo Yamashita and Tosuke Kaneko published by Taiseisha (1981), "Ultraviolet Curing System" by Kiyoshi Kato published by Sogo Gijutsu Center (1989), "WU•EB Curing Handbook (Raw Material Volume)" edited by kiyoshi Kato published by Kobunshi Kankokai (1985), "New Actual Technique of Photosensitive Resin" supervised by Kiyoshi Akamatsu published by CMC, pages 102–145 (1987) and the like.

In the hydrophilic binder polymer of this invention, when the dimensional cross-linking reaction is carried out using an ethylenic addition-polymerizable unsaturated group, it is preferable to use a known photopolymerization initiator or thermopolymerization initiator in view of reaction efficiency.

As the radical photopolymerization initiator, there are mentioned benzoin, benzoin isobutyl ether, enzoin isopropyl ether, benzophenone, Michler's ketone, anthone, thioxanthone, chloroxanthone, acetophenone, 2,2-dimethoxy-2-phenylacetophenone, benzil, 2,2-dimethyl-2-hydroxyacetophenone, (2-acryloyloxyethyl)(4-benzoylbenzyl)dimethylammonium bromide, (4-benzoylbenzyl)trimethylammonium chloride, 2-(3-dimethylamino-2-hydroxypropoxy)-3,4-dimethyl-9H-thioxanthon-9-one mesochloride, 1-phenyl-1,2-propanedione-2-(O-benzoyl)oxime, thiophenol, 2-benzothiazolethiol, 2-benzoxazolethiol, 2-benzimidazolethiol, diphenyl sulfide, decylphenyl sulfide, di-n-butyl disulfide, dibenzyl sulfide, dibenzoyl disulfide, diacetyl disulfide, dibornyl disulfide, dimethoxyxanthogene disulfide, tetramethylthiuram monosulfide, tetramethylthiuram tetrasulfide, benzyldimethyl dithiocarbamate quinoxaline, 1,3-dioxorane, N-laurylpyridinium and the like. From them may be adequately selected those which have absorption in the wavelength region of the light source used in the production process and are dissolved or dispersed in a solvent to be used in the preparation of a dope. Usually, those which are dissolved in the solvent used are high in reaction efficiency and hence preferable.

As the cationic photopolymerization initiator to be used in this invention, there are mentioned aromatic diazonium salt, aromatic iodonium salt, aromatic sulfonium salt and the like. When this initiator is used, an epoxy group can also be co-used as a cross-linking species. In this case, it is sufficient to use the above-mentioned epoxy group-containing compound as a cross-linking agent or as the hydrophilic binder polymer, or to introduce an epoxy group into the hydrophilic binder polymer.

When the three-dimensional cross-linking is effected by a photodimerization reaction, there can be used various sensitizers generally known in this reaction such as 2-nitrofluorene, 5-nitroacenaphthene and the like.

In addition to the above sensitizers, there can also be used the known polymerization initiators mentioned in "Sensitizer" by Katsumi Tokumaru et al., Chapters 2 and 4, published by Kodansha (1987), "Ultraviolet Curing System" by Kiyoshi Kato published by Sogo Gijutsu Center, pages 62 to 147 (1989) and Fine Chemical, Vol. 20, No. 4, page 16 (1991).

The above polymerization initiator added can be used in amounts ranging from 0.01% to 20% by weight based on the effective components other than the solvent in the dope. When the amount is less than 0.01% by weight, the effect of the initiator is inconsequential, and when the amount is more than 20% by weight, it becomes difficult for the light to reach the interior because the initiator self-absorbs the active light, so that the exertion of the desired plate wear becomes impossible in some cases. Practically, the amount of the initiator added is preferably determined in the range of 0.1 to 10% by weight depending upon the composition based on the balance between the effect of the initiator and the scumming of the non-image area.

As the irradiation light source, there can be used a known one such as metal halide lamp, high pressure mercury lamp, superhigh pressure mercury lamp, chemical lamp or the like. When there is a fear that the heat from the light source of irradiation may break the capsules, it is necessary that the irradiation be effected with cooling.

As the thermopolymerization initiator to be used in this invention, there can be used known ones, for example, a peroxide such as benzoyl peroxide, 2,2-azobisisobutyronitrile, persulfate-sodium hydrogensulfite or the like; an azo compound; and a redox initiator. When it is used, the reaction must be conducted at a temperature lower than the temperature at which the microcapsules are broken. The amount of the thermopolymerization initiator used is preferably in the range of 0.01 to 10% by weight based on the components other than the dope solvent. When the amount is less than 0.01% by weight, the curing time becomes too long and, when the amount is more than 10% by weight, gelation is caused in some cases by the decomposition of the thermopolymerization initiator during the dope preparation. When the effect and handleability are taken into consideration, the amount is preferably 0.1 to 5% by weight.

The degree of cross-linking of the hydrophilic binder polymer of this invention is varied depending upon the kind of segment used, the kind and amount of associable, functional group and the like; however, it is sufficient to determine the amount according to the required plate wear. The total amount of the Lewis base portions participating to the interaction with the polyvalent metal ion is preferably set so as to become 1 to 100%, more preferably 50 to 100%, based on the total monomer units. Moreover, the percentage of cross-linking other than by the interaction between the polyvalent metal ion and the Lewis base portion, namely the molecular weight between cross-linkages, is usually set in the range of 500 to 50,000. When it is less than 500, the product tends to become brittle and the plate wear is damaged. When it exceeds 50,000, the product is swollen with water for moistening and the plate wear is damaged thereby in some cases. Taking into consideration the balance between both plate wear and hydrophilicity, it is preferably about 800 to 30,000, more preferably about 1,000 to 10,000.

The fine particles referred to in this invention are those which are oleophilic monomers, synthetic or natural resins and the like finely dispersed in the hydrophilic layer and which can be exposed onto the hydrophilic layer surface by the melt diffusion or the like of the oleophilic component due to the thermal mode printing, thereby forming an image area. The fine particles used in this invention may be liquid or solid as far as they are finely dispersed in the state of plate and maintained in the fine particle state. Among them, those having such a structure that the internal oleophilic component and the hydrophilic layer are separated by a hydrophilic wall are particularly called microencapsulated oleophilic component in this invention. Taking into consideration the performance of the final printing plate, the microcapsule cell is preferred to the form in which the oleophilic material is directly dispersed in respects of the scumming of the non-image area and storability of plate.

It is preferable that the hydrophilic binder polymer of this invention has a functional group which chemically bonds with the oleophilic component, and by the chemical bonding of the two, a high plate wear can be obtained.

In order to react the oleophilic component with the hydrophilic binder polymer, it is sufficient to introduce the objective functional group into the polymer by synthesizing the hydrophilic binder polymer using monomers having a functional group which is selected in conformity with the reactive functional group of the oleophilic component stated hereinafter and can react therewith or to introduce the objective functional group after the synthesis of the hydrophilic binder polymer.

The reaction of the hydrophilic binder polymer with the oleophilic component is preferably a reaction high in reaction rate, for example, urethanization reaction or urea-forming reaction between a hydrophilic binder polymer having a hydroxyl group, a carboxyl group or an amino group and an oleophilic component having an isocyanate group, a reaction between a hydrophilic binder polymer having a hydroxyl group, a carboxyl group or an amino group and an oleophilic component having an epoxy group, or an addition-polymerization reaction of an unsaturated group. It may also be a ring-opening addition reaction between a hydrophilic binder polymer having an acid anhydride group and an oleophilic component having a hydroxyl group, an amino group or an imino group or an addition reaction between an unsaturated group and a thiol. In order to enhance the plate wear, it is preferable that the above chemical bonding forms a three-dimensionally cross-linked structure.

The oleophilic component of this invention preferably has a functional group which reacts with the hydrophilic binder polymer. In this case, the oleophilic component exposed by the thermal printing reacts rapidly with the hydrophilic binder polymer to form an image area which accepts a chemically bonded ink. In order to enhance the plate wear, it is preferable that the oleophilic component per se has also a cross-linked structure.

When a synthetic or natural resin is used as the fine particles, this resin may be a resin which has previously been formed into fine particles or may be obtained by polymerizing the corresponding monomers after they are finely dispersed in a hydrophilic layer.

As specific examples of the oleophilic component, there can be used, for example, isocyanates such as phenyl isocyanate, 2,4-tolylene diisocyanate, 2,6-tolylene diisocyanate, 4,4'-diphenylmethane diisocyanate, 3,3'-dimethylbiphenyl-4,41-diisocyanate, 1,5-naphthalene diisocyanate, tolidine diisocyanate, 1,6-hexamethylene diisocyanate, isophorone diisocyanate, xylylene diisocyanate, lydine diisocyanate, triphenylmethane triisocyanate, bicycloheptane triisocyanate, tolidene diisocyanate, polymethylene-polyphenyl isocyanate, polymeric polyisocyanate and the like; isocyanate compounds, for example, polyisocyanates such as a 1:3 molar adduct of trimethylolpropane to the above-mentioned diisocyanate such as 1,6-hexane diisocyanate or 2,4-tolylene diisocyanate, an oligomer of 2-isocyanatoethyl (meth) acrylate, a polymer thereof and the like; polyfunctional (meth)acrylic monomers such as N,N'-methylenebisacrylamide, (meth)acryloylmorpholine, vinylpyridine, N-methyl(meth)acrylamide, N,N'-dimethyl (meth)acrylamide, N,N'-dimethylaminopropyl(meth) acrylamide, N,N'-dimethylaminoethyl (meth)acrylate, N,N'-diethylaminoethyl (meth)acrylate, N,N'-dimethylaminoneopentyl (meth)acrylate, N-vinyl-2-pyrrolidone, diacetoneacrylamide, N-methylol(meth) acrylamide, parastyrenesulfonic acid and its salts, methoxytriethylene glycol (meth)acrylate, methoxytetraethylene glycol (meth)acrylate, methoxypolyethylene glycol (meth)acrylate (number average molecular weight of PEG: 400), methoxypolyethylene glycol (meth)acrylate (number average molecular weight of PEG: 1,000), butoxyethyl (meth)acrylate, phenoxyethyl (meth)acrylate, phenoxydiethylene glycol (meth)acrylate, phenoxyethylene glycol (meth) acrylate, phenoxypolyethylene glycol (meth)acrylate, nonylphenoxyethyl (meth)acrylate, dimethyloltricyclodecane di(meth)acrylate, diethylene glycol di(meth)acrylate, tetraethylene glycol di(meth)acrylate, polyethylene glycol di(meth)acrylate (number average molecular weight of PEG: 400), polyethylene glycol di(meth)acrylate (number average molecular weight of PEG: 600), polyethylene glycol di(meth)acrylate (number average molecular weight of PEG: 1,000), polypropylene glycol di(meth)acrylate (number average molecular weight of PPG: 400), 2,2-bis[4-(methacryloxyethoxy)phenyl]propane, 2,2-bis[4-methacryloxyediethoxy)phenyl]propane, 2,2-bis[4-(methacryloxyopolyethoxy)phenyl]propane and its acrylates, β-(meth)acryloyloxyethyl hydrogenphthalate, β-(meth)acryloyloxyethyl hydrogensuccinate, polyethylene and polyproylene glycol mono(meth)acrylates, 3-chloro-2-hydroxypropyl (meth)acrylate, 1,3-butylene glycol di(meth) acrylate, 1,6-hexanediol di(meth)acrylate, neopentyl glycol di(meth)acrylate, trimethylolpropane tri(meth)acrylate, tetramethylolmethane tri(meth)acrylate, tetramethylolmethane tetra(meth)acrylate, isobornyl (meth)acrylate, lauryl (meth) acrylate, tridecyl (meth)acrylate, stearyl (meth)acrylate, indecyl (meth)acrylate, cyclohexyl (meth)acrylate, tetrafurfuryl (meth)acrylate, benzyl (meth)acrylate, mono(2-acryloyloxyethyl) acid phosphate and its methacrylate, glycerol mono- and di-(meth)acrylates, tris(2-acryloxyethyl) isocyanurate and its methacrylate, 2-isocyanatoethyl (meth) acrylate and the like, combinations of the polyfunctional (meth)acrylate monomers with monofunctional (meth) acrylates and further combinations with the above-mentioned hydrophilic group-containing (meth)acrylate monomers; N-phenylmaleimide; N-(meth) acryloxysuccinimide; N-vinylcarbazole; divinylethyleneurea; divinylpropyleneurea; polyfunctional allyl compounds such as triallyl isocyanurate and the like; their combinations with monofunctional allyl compounds; further, liquid rubbers such as 1,2-polybutadiene, 1,4-polybutadiene, hydrogenated 1,2-polybutadiene, isoprene and the like which have reactive groups such as hydroxyl group, carboxyl group, amino group, vinyl group, thiol group, epoxy group and the like at both ends of the polymer molecule; various telechelic polymers such as urethane (meth)acrylate and the like; reactive waxes having a carbon—carbon unsaturated group, a hydroxyl group, a carboxyl group, an amino group or an epoxy group; polyfunctional epoxy compounds such as propylene glycol diglycidyl ether, tripropylene glycol diglycidyl ether, polypropylene glycol diglycidyl ether, neopentyl glycol diglycidyl ether, trimethylolpropane triglycidyl ether, hydrogenated bisphenol A diglycidyl ether and the like; etc. Furthermore, there can be used known (meth)acrylate copolymers and urethane acrylates before cross-linking which have been used as the image components of the existing PS plates and diazo resins. Also, as the synthetic or natural resins, there are mentioned polyamide type, polyester type, acrylic acid ester type, methacrylic acid type, acrylonitrile type, urethane type, polyvinylidene chloride type, polyvinyl chloride type, polyfluoroethylene type, polypropylene type, polyethylene type, polystyrene type, polybutadiene type and natural rubber type; in addition thereto, silicone types such as silicone, silicone acryl, silicone epoxy, silicone alkyd and silicone urethane; and the like, and if necessary, plural kinds of them may be used.

The oleophilic component may be either solid or liquid at room temperature. The polyisocyanate compound which is solid at room temperature includes, for example, tolidene diisocyanate, 4,4'-diphenylmethane diisocyanate, naphthalene diisocyanate, polymethylene-polyphenyl isocyanate, polymeric polyisocyanate and the like.

When the oleophilic component is chemically reacted with the hydrophilic binder polymer utilizing the double bond reaction of the ethylenic addition-polymerizable monomer and oligomer contained in the oleophilic component or the oleophilic component per se is reacted, the following thermopolymerization initiators can be used. The thermopolymerization initiators are preferably those which are stable even when stored at not more than 50° C., more preferable those which are stable at not more than 60° C. As the thermopolymerization initiator, there are mentioned peroxides, for example, methyl ethyl ketone peroxide, cyclohexanone peroxide, n-butyl 4,4-bis(t-butylperoxy) valerate, 1,1-bis(t-butylperoxy)cyclododecane, 2,2-bis(t-butylperoxy)butane, cumene hydroperoxide, p-menthane hydroperoxide, di-t-butyl peroxide, t-butylcumyl peroxide, dicumyl peroxide, t-butyl peroxylaurate, t-butyl peroxyisopropylcarbonate, t-hexyl peroxybenzoate, t-butyl peroxybenzoate, t-butyl peroxyacetate and the like.

As the method of adding the thermopolymerization initiator, said initiator may be microencapsulated and used in the form of capsule-in-capsule in the microcapsules of the oleophilic component, or may be dispersed as such in the hydrophilic layer. The curing of the oleophilic component can be effected by utilizing not only polymerization but also a reaction occurring in chemically bonding the oleophilic component with the hydrophilic binder polymer.

From the viewpoint of enhancing the plate wear of the image area, the image area of this invention has preferably a urethane or a urea structure. This can be carried out by either a method of converting the oleophilic component to the urethane or urea structure by the thermal reaction caused by printing or a method of introducing beforehand a urethane or urea structure into the oleophilic component or the segment of the hydrophilic binder polymer.

When the oleophilic component is encapsulated, it is in accordance with the known method described in, for example, "New Microencapsulation Technique and Its Use Development•Application Examples" edited by Keiei Kaihatsu Center Keiei Kyoikubu published by Keiei Kaihatsu Center Shuppanbu (1978). The encapsulation can be carried out by, for example, an interfacial polymerization method by which reactants which have previously been added to each of two liquids which are not dissolved in each other are poly-condensed at the interface of the two liquids to form a polymer film insoluble in the two solvents, thereby preparing a capsule film; an in-situ method by which reactants are fed from only either inside or outside of a core material to form a polymer wall around the core material; a complex coacervation method by which the hydrophilic polymer is subjected to phase separation on the surface of the hydrophobic material dispersed in the hydrophilic polymer solution to prepare a capsule film; a method of phase separation from an organic solution system, or the like. Among them, the interface polymerization method and the in-situ method are preferred because encapsulation of relatively many core materials is easily effected. The encapsulation may be effected with materials different from the oleophilic component. The form of the oleophilic component in the capsules produced may be different from the raw material state. For example, an oleophilic component whose raw material state is liquid may be converted during the synthesis to a gel state to such an extent that it can be fluidized by the heat applied by printing or to a highly viscous fluid or a solid, or contrarily, one whose raw material state is a solid may be converted to a liquid on the way of the synthesis.

The encapsulation referred to in this invention includes such a mode that a polyisocyanate solid at room temperature is formed into fine particles and the surfaces of the fine particles are blocked with the above-mentioned blocking agent to make them unable to react with the surrounding active hydrogen at room temperature. In any case, it is necessary that the oleophilic component in the capsules be liberated to the exterior of the capsules by the heat applied by printing to break the initial capsule form. For example, the oleophilic component is liberated by the expansion, compression, melting or chemical decomposition of the capsule wall or the density is lowered by expansion of this capsule wall material and the oleophilic component passes through the wall material layer to be liberated.

The shell surface of the capsule is not particularly limited unless the scumming of the non-image area is caused when the printing is effected in such a state that the microcapsules are contained in the hydrophilic layer; however, it is preferable that the surface is hydrophilic. The size of the microcapsule is not more than 10 $\mu$m on average, preferably not more than 5 $\mu$m on average, in uses of high resolving power. When the proportion of the oleophilic component to the total of capsules is too low, the image-forming efficiency is lowered, thus the size is preferably at least 0.1 $\mu$m.

As the above-mentioned microcapsule, there can be mentioned microcapsules obtained by emulsifying an oily component in the presence of a water-soluble alginic acid or its derivative and then subjecting the same to interfacial polymerization as shown in, for example, JP-A-08-181,937; microcapsules in which the wall material of the microcapsule is a polymer having an addition-polymerizable, functional group as shown in JP-A-08-180,480; microcapsules obtained by such an in-situ method that a radical-polymerizable monomer is added to a dispersion of materials to be encapsulated and polymerization is initiated with a redox initiator composed of a combination of non-water-soluble oxidizing agent/water-soluble reducing agent or a combination of water-soluble oxidizing agent/non-water-soluble reducing agent as shown in JP-A-08-326,548; and the like.

The amount of the microencapsulated oleophilic component used may be determined corresponding to the plate wear required for each printing use. Usually, the amount is selected from a range that the microcapsule/hydrophilic binder polymer weight ratio is 1/29 to 200/1, preferably from a range that the ratio is 1/15 to 100/1 from the viewpoint of sensitivity and plate wear.

To the hydrophilic layer of this invention can be further added, as another component, a sensitizer for the purposes of acceleration of thermal breakage of capsule; acceleration of reaction between the oleophilic component and the reactive material having a functional group which reacts with said another component and acceleration of reaction between the oleophilic component and the hydrophilic binder polymer. By this addition, it becomes possible to heighten the printing sensitivity, enhance the plate wear and make a plate at a high speed. As such a sensitizer, there are, for example, self-oxidizable materials such as nitrocellulose or the like; high strain compounds such as substituted cyclopropane, cuban and the like.

The polymerization catalyst for the oleophilic component can also be used as the sensitizer. As such a catalyst, for example, when the reaction of the oleophilic component is a reaction of an isocyanate group, there can be mentioned urethanization catalysts such as dibutyltin dilaurate, stannic chloride, amine compounds and the like, and when the above reaction is an epoxy group-ring-opening reaction, there can be mentioned ring-opening catalysts such as quaternary ammonium salts and the like. As to the sensitizer, there are a method in which the same is added in the preparation of a dope, a method in which the same is included simultaneously with the microencapsulation of the oleophilic component and a method in which the same is provided together with the binder resin between the support and the hydrophilic layer. The amount of the sensitizer used may be determined from the viewpoint of the effect of sensitizer, the plate wear of non-image area and the like.

In the case of laser printing, it is also possible to further use a light-heat converting material having an absorption band in the light emission wavelength region of the laser used. As such a material, there are mentioned such dyes, pigments and coloring matters as described in, for example, "JOEM Handbook 2 Absorption spectra of Dyes for Diode Lasers" by Masaru Matsuoka published by Bunshin Shuppan (1990) and "1990's Development of Functional Coloring Matters and Market Tendency" edited by CMC Editorial Department published by CMC (1990), Chapter 2, Paragraph 2.3, such as polymethin type coloring matter (cyanine coloring matter), phthalocyanine type coloring matter, dithiol metal complex salt type coloring matter, naphthoquinone, anthraquinone type coloring matter, triphenylmethane type coloring matter, aminium, diimmonium type coloring matter, azo type disperse dye, indoaniline metal complex coloring matter, intramolecular CT coloring matter and the like, and specifically, there are mentioned N-[4-[5-(4-dimethylamino-2-methylphenyl)-2,4-pentadienylidene]-3-methyl-2,5-cyclohexadien-1-ylidene]-N,N-dimethylammonium acetate, N-[4-[5-(4-dimethylaminophenyl)-3-phenyl-2-penten-4-in-1-ylidene]-2,5-cyclohexadien-1-ylidene]-N,N-dimethylammonium perchlorate, N,N-bis(4-dibutylaminophenyl)-N-[4-[N,N-bis(4-dibutylaminophenyl)amino]phenyl]aminium hexafluoroantimonate, 5-amino-2,3-dicyano-8-(4-ethoxyphenylamino)-1,4-naphthoquinone, N'-cyano-N-(4-diethylamino-2-methylphenyl)-1,4-naphthoquinonediimine, 4,11-diamino-2-(3-methoxybutyl)-1-oxo-3-thioxopyrrolo[3,4-b]anthracene-5,10-dione, 5,16(5H,16H)-diaza-2-butylamino-10,11-dithiadinaphtho[2,3-a:2',3'-c]naphthalene-1,4-dione, bis(dichlorobenzene-1,2-dithiol)

nickel(2:1)tetrabutylammonium, tetrachlorophthalocyanine aluminum chloride, polyvinylcarbazole-2,3-dicyano-5-nitro-1,4-naphthoquinone complex and the like.

For the purpose of accelerating the thermal breakage of microcapsule, a material which tends to be vaporized or volume-expanded when heated together with the oleophilic component can be incorporated together with the oleophilic component into the capsule. There are mentioned, for example, hydrocarbons, halogenated hydrocarbons, alcohols, ethers, esters and ketone compounds, the boiling points of which are sufficiently higher than room temperature and are in the vicinity of 60 to 100° C., such as cyclohexane, diisopropyl ether, ethyl acetate, ethyl methyl ketone, tetrahydrofuran, t-butanol, isopropanol and 1,1,1-trichloroethane.

From the viewpoint of facilitating the making of a plate test, it is preferable to use a known heat-sensitive coloring matter by which only the printed area develops a color, in combination with the oleophilic component to visualize the printed area. For example, a combination of 3-diethylamino-6-methyl-7-anilinofluoran with a leuco dye such as bisphenol A or the like and a pulverized developer and the like are included. The heat-sensitive coloring matters disclosed in books such as "Coloring Matter Handbook" edited by Makoto Okawara and others published by Kodansha (1986) and the like can be used.

Besides the hydrophilic binder polymer, a reactive material having a functional group which reacts with the oleophilic component can be used for heightening the degree of cross-linking of the oleophilic component. The amount of the reactive material added is adjusted to an amount that scumming is not caused depending on the degree of ink repellency and hydrophilicity of the hydrophilic binder polymer. As such a reactive material, for example, when the cross-linking reaction of the oleophilic component is a urethane-producing reaction, there are mentioned compounds having a plurality of hydroxyl groups, amino groups and carboxyl groups, for example, polyvinyl alcohol, polyamine, polyacrylic acid, trimethylolpropane and the like.

For the purpose of controlling the hydrophilicity, a non-reactive, hydrophilic polymer which does not react with the hydrophilic binder polymer and oleophilic component used may be added to the hydrophilic layer to such an extent that the plate wear is not damaged.

When printing is effected in thermal head, it is necessary to prevent the molten product, formed by heating, from adhering to the thermal head, and for this purpose, there can be added, as an absorber for the molten product, known compounds such as calcium carbonate, silica, zinc oxide, titanium oxide, kaolin, calcined kaolin, hydrated halloysite, alumina sol, diatomaceous earth, talc and the like. In addition, for the purpose of both enhancement of the sliding of the plate and prevention of adhesion when the plates are put one on another, a small amount of a normally solid lubricant such as stearic acid, myristic acid, dilauryl thiodipropionate, stearoamide, zinc stearate or the like can be added to the hydrophilic layer.

The support used in this invention may be selected from known materials considering the performance and cost required in the printing field. When such a high dimensional accuracy as in multicolor printing is required, or printing is effected in a printing machine prepared so that the mounting system on the plate cylinder matches with a metal support, it is preferable to use a metal support such as a support made of aluminum, steel or the like. When the multicolor printing is not effected and a high plate wear is required, a plastic support such as polyester support or the like can be used and in the field in which a low cost is required, a paper support, a synthetic paper support, a waterproof resin laminate support or a coated paper support can be used. Moreover, a composite support in which an aluminum layer is provided on paper or a plastic sheet by a technique such as vapor deposition, lamination or the like; etc. can be used. A support which itself has been subjected to surface treatment can be used for enhancing the adhesiveness to a material contacting with the support. In the case of the plastic sheet, a corona discharge treatment, a blast treatment and the like can be mentioned as preferable methods. In the case of aluminum, there are preferably used those which have been subjected to degreasing/surface roughening treatment, degreasing/electropolishing/anodic oxidation treatment or the like using the method described in known literature references such as "Aluminum Surface Treatment" by Sadajiro Kokubo (published by Uchida Rokakuho Shinsha, 1975); "Plate-Making and Printing Technique of PS Plate" by Yoshio Daimon (published by Nippon Insatsu 1976); "PS Plate Introduction" by Teruhiko Yonezawa (published by Insatsu Gakkai Shuppanbu, 1993) and the like.

An adhesive layer can be provided on the support, if necessary, for plate wear or the like. In general, when a high plate wear is required, an adhesive layer is provided. The adhesive is required to be selected and/or designed in conformity with the hydrophilic layer and the support used. The adhesives of acryl type, urethane type, cellulose type, epoxy type, allylamine type and the like can be used which are described in "Cyclopedia of Adhesion and Sticking" supervised by Shozaburo Yamada published by Asakura Shoten (1986); "Adhesion Handbook" edited by Nippon Setchaku Kyokai published by Nihon Kogyo Shinbunsha (1980) and the like.

The heat-sensitive, lithoprinting, original plate of this invention can be produced by the following method. A heat-sensitive, lithoprinting material is obtained by well dispersing the above-mentioned components together with a solvent selected depending on the kinds of the components and the method of cross-linking the hydrophilic binder polymer by means of a paint shaker, a ball mill, an ultrasonic homogenizer or the like and coating the resulting coating solution (dope) on a support by a known method such as a doctor blade method, a bar coat method, a roll coat method, a die coat method or the like and drying the same.

As the solvent, there can be used water; alcohols such as ethanol, isopropanol, n-butanol and the like; ketones such as acetone, methyl ethyl ketone and the like; ethers such as diethylene glycol diethyl ether, diethyl ether, diisopropyl ether, dioxane, tetrahydrofuran, diethylene glycol and the like; esters such as ethyl acetate, butyl acetate and the like; aromatic hydrocarbons such as toluene, xylene and the like; aliphatic hydrocarbons such as n-hexane, decalin and the like; dimethylformamide; dimethylsulfoxide; acetonitrile; and mixed solvents of them.

Further, an additional heating or an ultraviolet irradiation is, if necessary, effected at a temperature lower than the temperature at which the microcapsules are broken in order to three-dimensionally cross-link the hydrophilic binder polymer.

The thickness of the coating film free from the hydrophilic polymer thin film layer may be set arbitrarily between 0.1 $\mu$m and 100 $\mu$m. Usually, a thickness of 1 to 10 $\mu$m is preferable in view of performance versus cost.

Thereafter, this heat-sensitive, lithoprinting material obtained is immersed in such an aqueous or organic solution as to generate a polyvalent metal ion, or the aqueous or organic solution is coated or sprayed on the heat-sensitive, lithoprinting material, to feed the polyvalent metal ion, thereby forming a three-dimensional cross-linkage due to the interaction between the polyvalent metal ion and the Lewis base portion, after which a hydrophilic polymer thin film is formed on the hydrophilic layer surface by immersing in or coating or spraying with a solution of a polymer for the hydrophilic polymer thin film, whereby the heat-sensitive, lithoprinting, original plate of this invention can be obtained. If it is necessary to increase the surface smoothness, it is sufficient to subject the original plate to calender treatment after the coating/drying or after the three-dimensional cross-linking reaction of the hydrophilic binder polymer. If a particularly high smoothness is necessary, it is preferable to effect the calender treatment after the coating/drying.

For subjecting the heat-sensitive, lithoprinting, original plate of this invention to plate-making, it is sufficient to only draw and print letters and picture prepared and edited by an electronic composing machine, DTP, a word processor, a personal computer or the like in a thermal head or with a laser of thermal mode, and the plate-making is completed without any developing step. After printing, by heating at a temperature at which the capsules are not broken (post curing), or irradiating the whole plate surface with an active light, the degree of cross-linking in the image area can be increased. When the latter method is carried out, it is necessary to co-use, in the hydrophilic layer, the above-mentioned photopolymerization initiator or cationic photopolymerization initiator and a compound having a functional group by which the reaction is accelerated, or introduce the said functional group into the oleophilic component. As the above-mentioned initiator and the compound having the functional group, there can be used, in addition to those as mentioned above, the known ones described in books such as "Ultra-violet Curing System" edited by Kiyoshi Kato published by Sogo Gijutsu Center (1989); "UV·EB Curing Handbook (Raw Material Edition)" edited by Kiyoshi Kato published by Kobunshi Kankokai (1985) and the like.

Moreover, in this invention, it is possible to print on the heat-sensitive, lithoprinting material by the above-mentioned method, thereafter feed a polyvalent metal ion to form a three-dimensional cross-linkage due to interaction between the polyvalent metal ion and the Lewis base portion, and further provide a hydrophilic polymer thin film on the hydrophilic layer surface to make a plate.

The lithoprinting plate thus obtained can be set in a commercial offset press and used in printing in a usual manner. In the printing, if necessary, the lithoprinting plate can be subjected to usual etching treatment and then used in the printing.

This invention is specifically explained below by Examples. Incidentally, in the description of the Examples, part and % are by weight unless otherwise specified.

EXAMPLE 1

(1) Preparation of microencapsulated oleophilic component

In 7.2 g of glycidyl methacrylate were uniformly dissolved 1.26 parts of an adduct of 3 moles tolylene diisocyanate/1 mole trimethylolpropane (Coronate L manufactured by NIPPON POLYURETHANE INDUSTRY CO., LTD., containing 25% by weight of ethyl acetate) and 0.3 part of near infrared-absorbing colorant (Kayasorb IR-820 B manufactured by NIPPON KAYAKU CO., LTD.) to prepare an oily component. Subsequently, an aqueous phase was prepared by mixing 120 g of purified water with 2 parts of propylene glycol alginate (DUCK LOID LF manufactured by KIBUN FOOD CHEMIFA CO., LTD., number average molecular weight: $2\times10^5$) and 0.86 part of polyethylene glycol (PEG 400, manufactured by SANYO CHEMICAL INDUSTRIES, LTD.). Subsequently, the above oily component and the aqueous phase were mixed and emulsified at room temperature at 6,000 rpm using a homogenizer, and then subjected to reaction at 60° C. for 3 hours to obtain microcapsules having an average particle diameter of 1.8 μm.

(2) Preparation of heat-sensitive lithoprinting, original plate

An aluminum plate which had been subjected to anodic oxidation (thickness: 0.24 μm, 310 mm×458 mm) was coated by a bar coater (Rod No. 16) a dope prepared by blending 20.0 parts of a 10% by weight aqueous solution of polyacrylic acid (Julimer AC10MP manufactured by Nippon Junyaku K. K., number average molecular weight: $8\times10^4$), 80.0 parts of the microencapsulated oleophilic component prepared in (1) above and 300 parts of a 3% by weight aqueous solution of propylene glycol alginate (DUCK LOID LF manufactured by KIBUN FOOD CHEMIFA CO., LTD.) and air-dried at room temperature overnight to obtain a heat-sensitive, lithoprinting material. The thickness of the heat-sensitive, lithoprinting material was 4.2 μm. Subsequently, this plate was immersed in 1.5 liters of a 5% aqueous solution of stannic chloride pentahydrate (manufactured by Tokyo Kasei K. K.) for 3 minutes and then washed with 1 liter of purified water (manufactured by WAKO PURE CHEMICAL INDUSTRIES, LTD.) for 1 minute. Further, this was immersed in a 0.5% aqueous solution of polyacrylic acid (Julimer AC10P manufactured by Nippon Junyaku K. K., number average molecular weight: $5\times10^3$) for 1 minute, and thereafter made stand vertically and air-dried at room temperature for 24 hours to obtain a heat-sensitive, lithoprinting, original plate. The thickness of the hydrophilic polymer thin film layer was 0.2 μm. Incidentally, the thickness of the hydrophilic polymer thin film layer was determined from the difference in thickness between the heat-sensitive, lithoprinting material and the heat-sensitive, lithoprinting, original plate as measured by a film thickness measuring machine ("KEITARO" manufactured by Kabushiki Kaisha Seiko).

(3) Preparation of lithoprinting plate and printing

A printing image was thermally printed on the heat-sensitive, lithoprinting, original plate prepared in (2) above by means of a printing apparatus mounting 1 W semiconductor laser device connected with an electronic composing apparatus and the whole surface of the plate was irradiated at a rate of 6 J/cm$^2$ by a chemical lamp. This plate was subjected to trimming and mounted on an offset press (HAMADA611XL manufactured by Hamada Insatsu Kikai K. K.) and wood-free paper was subjected to printing thereby (the ink used was GEOS-G manufactured by DAINIPPON INK AND CHEMICALS, INC. and as the wetting water, a 100-time dilution of EU-3 manufactured by Fuji Photo Film Co., Ltd. was used). Even after printing 20,000 copies, scumming was not found and the image area was also printed clearly. The paper reflection densities of the non-image area before and after the printing were measured by a reflection densitometer (DM400 manufactured by DAINIPPON SCREEN MFG. CO., LTD.) to find that the different between the two (ΔOD) was 0.00, and no scumming was confirmed visually. Moreover, the reflection density (OD) in the solid image area was 1.2. In addition, no peel of the heat-sensitive layer was observed. These results are shown in Table 1.

EXAMPLE 2

The preparation of a printing plate and the print evaluation were conducted in the same manner as in Example 1, except that a polyacrylamide (number average molecular weight: $3\times10^5$) was substituted for the polyacrylic acid (AC10MP) of Example 1. The results are shown in Table 1. In addition, the thickness of the heat-sensitive, lithoprinting material was 4.5 μm and the thickness of the hydrophilic polymer thin film layer was 0.2 μm.

EXAMPLE 3

The preparation of a printing plate and the print evaluation were conducted in the same manner as in Example 1, except that zirconium acetate was substituted for the stannic chloride pentahydrate of Example 1. The results are shown in Table 1. Moreover, the thickness of the heat-sensitive, lithoprinting material was 4.3 μm and the thickness of the hydrophilic polymer thin film layer was 0.2 μm.

EXAMPLE 4

The preparation of a printing plate and the print evaluation were conducted in the same manner as in Example 1, except that ferric sulfate was substituted for the stannic chloride pentahydrate of Example 1. The results are shown in Table 1. Moreover, the thickness of the heat-sensitive, lithoprinting material was 4.2 μm and the thickness of the hydrophilic polymer thin film layer was 0.2 μm.

EXAMPLE 5

(1) Synthesis of hydrophilic binder polymer

In a separable flask were placed 248.5 parts of acrylic acid and 2,000 parts of toluene after metering, and thereto was gradually added dropwise a solution of 2.49 parts of azobisisobutyronitrile (referred to hereinafter as AIBN) in 24.9 parts of toluene with stirring at room temperature. Thereafter, the reaction mixture was heated to 60° C. and stirred for 3 hours. The polymer produced and precipitated was filtered and washed with about 2 liters of toluene, substantially dried at 800 and thereafter further dried in vacuo until the weight became constant to obtain 235 parts of a primary polymer (the number average molecular weight according to the GPC method: $6\times10^4$). Subsequently, in a separable flask, 35.5 parts of the primary polymer was dissolved in 355 parts of distilled water. While dried air was introduced into the flask, a solution consisting of 2.84 parts of glycidyl methacrylate, 0.1 part of 2,6-di-5-butyl-p-cresol (referred to herein-after as BHT) and 1 part of triethylbenzylammonium chloride was added from a dropping funnel to the flask over 30 minutes while the contents of the flask were stirred. After completion of the addition, the temperature was gradually elevated and stirring was conducted at 80° C. for 1 hour. At this time, the desired acid value was reached. The contents were cooled, the polymer was isolated in acetone and then the polymer was crumpled and washed. Thereafter, the polymer was dried in vacuo at room temperature to obtain a polymer having an addition-polymerizable unsaturated group (the proportion of the addition-polymerizable unsaturated group introduced was 2.2% as measured by the NMR method).

(2) Preparation of heat-sensitive, lithoprinting, original plate

In the same manner as in Example 1, an aluminum plate (thickness: 0.24 μm, 310 mm×458 mm) which had been subjected to anodic oxidation was coated by a bar coater (Rod No. 16) with a dope prepared by blending 20.0 parts of a 10% aqueous solution of the hydrophilic binder polymer synthesized in (1) above, 80.0 parts of the microencapsulated oleophilic component prepared in Example 1 (1), 300 parts of a 3% by weight aqueous solution of propylene glycol alginate (DUCK LOID LF manufactured by KIBUN FOOD CHEMIFA CO., LTD.) and 1 part of a 2% aqueous solution of (2-acryloyloxyethyl)(4-benzoylbenzyl) dimethylammonium bromide and then the coated plate was air-dried at room temperature overnight to obtain a heat-sensitive, lithoprinting material. The thickness of the heat-sensitive, lithoprinting material was 4.1 μm. Subsequently, this plate was immersed in 1.5 liters of a 5% aqueous solution of stannic chloride pentahydrate (manufactured by Tokyo Kasei K. K.) for 3 minutes and then washed with 1 liter of purified water (manufactured by WAKO PURE CHEMICAL INDUSTRIES, LTD.) for 1 minute. Further, this was immersed in a 0.5% aqueous solution of a polyacrylic acid (Julimer AC10P manufactured by Nippon Junyaku K. K.) for 1 minute, and then made stand vertically and air-dried as such at room temperature for 24 hours to prepare a heat-sensitive, lithoprinting, original plate. The thickness of the hydrophilic polymer thin film layer was 0.2 μm.

(3) Preparation of lithoprinting plate and printing

Using the lithoprinting material prepared in (2) above and in the same manner as in Example 1, the preparation of a lithoprinting plate and the print evaluation were conducted. The results are shown in Table 1.

EXAMPLE 6

In the same manner as in Example 5, except that a polyacrylic acid (AC10MP, the number average molecular weight: $8\times10^4$) was substituted for the polyacrylic acid (AC10P) of Example 5, the preparation of a printing plate and the print evaluation were conducted. The results are shown in Table 1. Moreover, the thickness of the heat-sensitive, lithoprinting material was 4.3 μm and the thickness of the hydrophilic polymer thin film layer was 0.3 μm.

EXAMPLE 7

In the same manner as in Example 5, except that a polyacrylamide (number average molecular weight: $1\times10^4$) was substituted for the polyacrylic acid (AC10P) of Example 5, the preparation of a printing plate and the print evaluation were conducted. The results are shown in Table 1. Moreover, the thickness of the heat-sensitive, lithoprinting material was 4.2 μm and the thickness of the hydrophilic polymer thin film layer was 0.3 μm.

EXAMPLE 8

In the same manner as in Example 5, except that a polyallylamine (number average molecular weight: $1\times10^4$) was substituted for the polyacrylic acid (AC10P) of Example 5, the preparation of a printing plate and the print evaluation were conducted. The results obtained are shown in Table 1. Moreover, the thickness of the heat-sensitive, lithoprinting material was 4.3 μm and the thickness of the hydrophilic polymer thin film layer was 0.2 μm.

EXAMPLE 9

(1) Preparation of heat-sensitive lithoprinting material

In the same manner as in Example 1, an aluminum plate (thickness: 0.24 μm, 310 mm×458 mm) which had been subjected to anodic oxidation was coated by a bar coater (Rod No. 16) with a dope prepared by blending 20.0 parts of a 10% by weight aqueous solution of a polyacrylic acid (Julimer AC10MP manufactured by Nippon Junyaku K. K.), 80.0 parts of the microencapsulated oleophilic component prepared in Example 1 (1) and 300 parts of a 3% by weight aqueous solution of propylene glycol alginate (DUCK LOID LF manufactured by KIBUN FOOD CHEMIFA CO., LTD.) and air-dried at room temperature overnight. The thickness of the heat-sensitive, lithoprinting material was 4.2 μm.

(2) Preparation of lithoprinting plate and print evaluation

A printing image was thermally printed on the heat-sensitive, lithoprinting material prepared in (1) above by means of a printing apparatus mounting 1 W semiconductor laser device connected with an electronic composing apparatus and the whole surface of the plate was irradiated at a rate of 6 J/cm$^2$ by a chemical lamp. Subsequently, this plate was immersed in 1.5 liters of a 5% aqueous solution of stannic chloride pentahydrate (manufactured by Tokyo Kasei K. K.) for 3 minutes and then washed with 1 liter of purified water (manufactured by WAKO PURE CHEMICAL INDUSTRIES, LTD.) for 1 minute. Further, this was immersed in a 0.5% aqueous solution of a polyacrylic acid (Julimer AC10P manufactured by Nippon Junyaku K. K.) for 1 minute, then made stand vertically and air-dried as such at room temperature for 24 hours to prepare a lithoprinting plate. The thickness of the hydrophilic polymer thin film layer was 0.2 $\mu$m. Using this, print evaluation was conducted in the same manner as in Example 1. The results are shown in Table 1.

COMPARATIVE EXAMPLE 1

In the same manner as in Example 1, except that the immersion in a 5% aqueous solution of stannic chloride pentahydrate, the water-washing, the immersion in an aqueous solution of a polyacrylic acid (AC10P) and the drying were not conducted, the coating, plate-making and printing were conducted. The thickness of the heat-sensitive, lithoprinting plate was 4.1 $\mu$m. As a result, when about 100 copies were printed, such a phenomenon that the coated layer was peeled was observed. The results are shown in Table 1.

COMPARATIVE EXAMPLE 2

In the same manner as in Example 1, except that a 5% aqueous solution of sodium carbonate was substituted for the 5% aqueous solution of stannic chloride pentahydrate, the coating, plate-making and printing were conducted. The thickness of the heat-sensitive, lithoprinting material was 4.2 $\mu$m and the thickness of the hydrophilic polymer thin film layer was 0.2 $\mu$m. As a result, when about 100 copies were printed, such a phenomenon that the coated layer was peeled was observed. The results are shown in Table 1.

TABLE 1

| | | Degree of contamination in non-image area | Solid image density | Peel of coating film |
|---|---|---|---|---|
| Example | 1 | ΔOD = 0.00, Visually no contamination | OD = 1.2 | None |
| | 2 | ΔOD = 0.00, Visually no contamination | OD = 1.2 | None |
| | 3 | ΔOD = 0.00, Visually no contamination | OD = 1.2 | None |
| | 4 | ΔOD = 0.00, Visually no contamination | OD = 1.2 | None |
| | 5 | ΔOD = 0.00, Visually no contamination | OD = 1.2 | None |
| | 6 | ΔOD = 0.00, Visually no contamination | OD = 1.2 | None |
| | 7 | ΔOD = 0.00, Visually no contamination | OD = 1.2 | None |
| | 8 | ΔOD = 0.00, Visually no contamination | OD = 1.2 | None |
| | 9 | ΔOD = 0.00, Visually no contamination | OD = 1.2 | None |
| Comparative | 1 | — | — | Whole surface was peeled. |
| Example | 2 | — | — | Whole surface was peeled. |

Industrial Applicability

In this invention, the hydrophilic binder polymer in a hydrophilic layer is three-dimensionally cross-linked by the strong interaction between a polyvalent metal ion and the Lewis base portion in the binder polymer, so that a lithoprinting plate which causes little scumming and a lithoprinting, original plate capable of producing the same can be provided. The heat-sensitive, lithoprinting, original plate of this invention does not require development in the plate-making process of this invention because the non-image area of the original plate is mainly formed of a hydrophilic polymer, and therefore, such procedures as control of developer and disposal of waste liquid are not necessary and it becomes possible to aim for working efficiency and cost reduction. Moreover, the plate-making apparatus can be made compact and the apparatus cost can be designed to be low, and hence, this invention is very useful in industry.

What is claimed is:

1. A lithoprinting plate comprising a support and a recording layer which comprises a polyvalent metal ion and a hydrophilic binder polymer having a Lewis base portion containing nitrogen, oxygen or sulfur and which has an oleophilic image area and a hydrophilic non-image area printed in a thermal mode, wherein the hydrophilic binder polymer in the hydrophilic non-image area is three-dimensionally cross-linked by the interaction between the polyvalent metal ion and the Lewis base portion.

2. A process for producing the lithoprinting plate according to claim 1, which comprises printing in a thermal mode, a heat-sensitive, lithoprinting, original plate comprising a support and a recording layer which comprises fine particles to be converted to an image area by heating and a hydrophilic binder polymer containing a polyvalent metal ion and having a Lewis base portion containing nitrogen, oxygen or sulfur, wherein the above hydrophilic binder polymer is three-dimensionally cross-linked by the interaction between the polyvalent metal ion and the Lewis base portion, to form an oleophilic image area in the recording layer.

3. A process according to claim 2, wherein said interaction between a polyvalent metal ion and a hydrophilic binder polymer having a Lewis base portion containing nitrogen, oxygen or sulfur is formed by using a solution of a metal salt selected from the group consisting of a metal halide, a nitrate, a sulfate, an acetate and ammonium zirconium carbonate, iron ferrocyanide and iron ferricyanide.

4. A process for producing the lithoprinting plate according to claim 1 which comprises subjecting to printing in a thermal mode a heat-sensitive, lithoprinting material comprising a support and a recording layer containing fine particles which are converted to an image area by heating and an noncross-linked binder polymer having a Lewis base portion containing nitrogen, oxygen or sulfur to form an oleophilic image area; thereafter three-dimensionally cross-linking the hydrophilic binder polymer in the non-image area by the interaction between the polyvalent metal ion fed from the exterior and the above Lewis base portion.

5. A process according to claim 4, wherein said interaction between a polyvalent metal ion fed from the exterior and a noncross-linked hydrophilic binder polymer having a base portion is formed by using a solution of a metal salt selected from the group consisting of a metal halide, a nitrate, a sulfate, an acetate and ammonium zirconium carbonate, iron ferrocyanide and iron ferricyanide.

6. A heat-sensitive, lithoprinting, original plate comprising a support and a hydrophilic layer which comprises fine particles to be converted to an image area by heating and a hydrophilic binder polymer containing a polyvalent metal ion and having a Lewis base portion containing nitrogen, oxygen or sulfur, wherein the above hydrophilic binder polymer is three-dimensionally cross-linked by the interaction between the above polyvalent metal ion and the above Lewis base portion.

7. The heat-sensitive, lithoprinting, original plate according to claim 6, wherein the hydrophilic binder polymer has a functional group which chemically bonds with the fine particle component and the fine particle component has a functional group which chemically bonds with the above hydrophilic binder polymer.

8. The heat-sensitive, lithoprinting, original plate according to claim 6 or 7, wherein the fine particles are of a microencapsulated oleophilic material.

9. The heat-sensitive, lithoprinting, original plate according to claim 6, which has a hydrophilic polymer thin film layer on the surface of the hydrophilic layer.

10. The heat-sensitive, lithoprinting, original plate according to claim 6, wherein the polymer used in the hydrophilic polymer thin film layer is at least one member selected from the group consisting of a polymer which is composed of carbon atoms or carbon—carbon bonds connected with at least one hetero atom selected from the group consisting of oxygen, nitrogen, sulfur and phosphor; a polymer which is composed of carbon—carbon bonds or composed of carbon atoms or carbon—carbon bonds connected with at least one hetero atom selected from the group consisting of oxygen, nitrogen, sulfur and phosphor and which contains in its structure at least one hydrophilic, functional group selected from the group consisting of phosphoric acid group, sulfonic acid group or their salts, hydroxyl group and polyoxyethylene group; a polymer which is composed of carbon—carbon bonds or composed of carbon atoms or carbon—carbon bonds connected with at least one hetero atom selected from the group consisting of oxygen, nitrogen, sulfur and phosphor and which has in its structure a Lewis base portion containing nitrogen, oxygen or sulfur; and this Lewis base portion-containing polymer which further contains in its structure at least one hydrophilic, functional group selected from the group consisting of phosphoric acid group, sulfonic acid group or their salts, hydroxyl group and polyoxyethylene group.

11. The heat-sensitive, lithoprinting, original plate according to claim 6, wherein the polymer used in the hydrophilic polymer thin film layer is a polymer synthesized using at least one member selected from the group consisting of (meth)acrylic acid, itaconic acid and their alkali metal or amine salts, (meth)acrylamide, N-monomethylol(meth) acrylamide, N-dimethylol(meth)acrylamide, allylamine and their mineral acid salts, vinylsulfonic acid, 2-acrylamido-2-methylpropanesulfonic acid and their alkali metal or amine salts, 2-sulfoethyl methacrylate, polyoxyethylene glycol mono(meth)acrylate and acid phosphoxypolyoxyethylene glycol mono(meth)acrylate.

12. The heat-sensitive, lithoprinting, original plate according to claim 6, wherein the polyvalent metal ion is at least one member selected from the group consisting of magnesium ion, aluminum ion, calcium ion, titanium ion, ferrous ion, cobalt ion, copper ion, strontium ion, zirconium ion, stannous ion, stannic ion and lead ion.

13. The heat-sensitive, lithoprinting, original plate according to claim 6, wherein the Lewis base portion containing nitrogen, oxygen or sulfur is at least one member selected from the group consisting of amino group, monoalkylamino group, dialkylamino group, trialkylamino group, isoureido group, isothioureido group, imidazolyl group, imino group, ureido group, epiimino group, ureylene group, oxamoyl group, oxalo group, oxaloaceto group, carbazoyl group, carbazolyl group, carbamoyl group, carboxyl group, carboxylato group, carboimidoyl group, carbonohydrazido group, quinolyl group, guanidino group, sulfamoyl group, sulfinamoyl group, sulfoamino group, semicarbazido group, semicarbazono group, thioureido group, thiocarbamoyl group, triazano group, triazeno group, hydrazino group, hydrazo group, hydrazono group, hydroxyamino group, hydroxyimino group, nitrogen-containing heterocyclic ring, formamido group, formimidoyl group, 3-morpholinyl group and morpholino group.

14. The heat-sensitive, lithoprinting, original plate according to claim 6, wherein the hydrophilic binder polymer is at least one member selected from the group consisting of a polymer which is composed of carbon—carbon bonds or composed of carbon atoms or carbon—carbon bonds connected with at least one hetero atom selected from the group consisting of oxygen, nitrogen, sulfur and phosphor and which has in its polymer structure a Lewis base portion containing nitrogen, oxygen or sulfur which can interact or has interacted with the polyvalent metal ion; and this Lewis base portion-containing polymer which further contains in its polymer structure at least one hydrophilic, functional group selected from the group consisting of phosphoric acid group, sulfonic acid group or their salts, hydroxyl group and polyoxyethylene group.

15. The heat-sensitive, lithoprinting, original plate according to claim 6, wherein the hydrophilic binder polymer is a polymer synthesized using monomers comprising at least one member selected from the group consisting of (meth)acrylic acid, itaconic acid and their alkali metal or amine salts, (meth)acrylamide, N-monomethylol(meth) acrylamide, N-dimethylol(meth)acrylamide, allylamine and their mineral acid salts, and the polyvalent metal ion is at least one member selected from the group consisting of ferrous ion, zirconium ion and stannic ion.

16. A heat-sensitive, lithoprinting material which comprises a support and a recording layer containing a hydrophilic binder polymer, a polyvalent metal ion and fine particles which are converted to an image area by heat, wherein the hydrophilic binder polymer is a noncross-linked, hydrophilic binder polymer having a Lewis bases portion containing nitrogen, oxygen or sulfur.

17. The heat-sensitive, lithoprinting material according to claim 16, wherein the hydrophilic binder polymer has a functional group which chemically bonds with the fine particle component and the fine particle component has a functional group which chemically bonds with the above hydrophilic binder polymer.

18. The heat-sensitive lithoprinting material according to claim 16 or 17, wherein the fine particles are of microencapsulated oleophilic materials.

19. The heat-sensitive, lithoprinting material according to claim 16, wherein the Lewis base portion containing nitrogen, oxygen or sulfur is at least one member selected from the group consisting of amino group, monoalkylamino group, dialkylamino group, trialkylamino group, isoureido group, isothioureido group, imidazolyl group, imino group, ureido group, epiimino group, ureylene group, oxamoyl group, oxalo group, oxaloaceto group, carbazoyl group, carbazolyl group, carbamoyl group, carboxyl group, carboxylato group, carboimidoyl group, carbonohydrazido group, quinolyl group, guanidino group, sulfamoyl group, sulfinamoyl group, sulfoamino group, semicarbazido group, semicarbazono group, thioureido group, thiocarbamoyl group, triazano group, triazeno group, hydrazino group, hydrazono group, hydroxyamino group, hydroxyimino group, nitrogen-containing, heterocyclic ring, formamido group, formimidoyl group, 3-morpholinyl group and morpholino group.

20. The heat-sensitive, lithoprinting material according to claim 16, wherein the hydrophilic binder polymer is at least one member selected from the group consisting of a polymer which is composed of carbon—carbon bonds or composed of carbon atoms or carbon—carbon bonds connected with at least one hetero atom selected from the group consisting of oxygen, nitrogen, sulfur and phosphor and which has in its polymer structure a Lewis base portion containing nitrogen, oxygen or sulfur which portion can interact or has interacted with the polyvalent metal ion; and this Lewis base portion-containing polymer which further contains in its polymer structure at least one hydrophilic, functional group selected from the group consisting of phosphoric acid group, sulfonic acid group or their salts, hydroxyl group and polyoxyethylene.

21. The heat-sensitive, lithoprinting material according to claim 16, which has a hydrophilic polymer thin film layer on the surface of the recording layer, wherein the polymer used in the hydrophilic polymer thin film layer is at least one member selected from the group consisting of a polymer which is composed of carbon atoms or carbon—carbon bonds connected with at least one hetero atom selected from the group consisting of oxygen, nitrogen, sulfur and phosphor; a polymer which is composed of carbon—carbon bonds or composed of carbon atoms or carbon—carbon bonds connected with at least one hetero atom selected from the group consisting oxygen, nitrogen, sulfur and phosphor and which has in its structure at least one hydrophilic, functional group selected from the group consisting of phosphoric acid group, sulfonic acid group or their salts, hydroxyl group and polyoxyethylene group; a polymer which is composed of carbon—carbon bonds or composed of carbon atoms or carbon—carbon bonds connected with at least one hetero atom selected from the group consisting of oxygen, nitrogen, sulfur and phosphor and which has in its structure a Lewis base portion containing nitrogen, oxygen or sulfur; and this Lewis base portion-containing polymer which further has in its structure at least one hydrophilic, functional group selected from the group consisting of phosphoric acid group, sulfonic acid group or their salts, hydroxyl group and polyoxyethylene group.

22. The heat-sensitive, lithoprinting material according to claim 16, wherein the hydrophilic binder polymer is a polymer synthesized using monomers comprising at least one member selected from the group consisting of (meth) acrylic acid, itaconic acid and their alkali metal or amine salts, (meth)acrylamide, N-monomethylol(meth) acrylamide, N-dimethylol(meth)acrylamide and allylamine and its mineral acid salts.

23. The heat-sensitive, lithoprinting material according to claim 16, wherein the polymer used in the hydrophilic polymer thin film layer is a polymer synthesized using at least one member selected from the group consisting of (meth)acrylic acid, itaconic acid and their alkali metal or amine salts, (meth)acrylamide, N-monomethylol(meth) acrylamide, N-dimethylol(meth)acrylamide, allylamine and its mineral acid salts, vinylsulfonic acid, 2-acrylamido-2-methylpropanesulfonic acid, and their alkali metal or amine salts and 2-sulfoethyl methacrylate, polyoxyethylene glycol mono(meth)acrylate and acid phosphoxypolyoxyethylene glycol mono(meth)acrylate.

24. A composition for heat-sensitive lithoprinting which comprises a hydrophilic binder polymer, a polyvalent metal ion and fine particles which are converted to an image area by heat, wherein the hydrophillic binder polymer is a noncross-linked, hydrophilic binder polymer having a Lewis base portion containing nitrogen, oxygen or sulfur.

25. A recording layer for heat-sensitive lithoprinting which comprises the composition of claim 24.

* * * * *